US007237882B2

(12) United States Patent
Miyazawa et al.

(10) Patent No.: US 7,237,882 B2
(45) **Date of Patent: *Jul. 3, 2007**

(54) INK CARTRIDGE HAVING RETAINING STRUCTURE AND RECORDING APPARATUS FOR RECEIVING THE INK CARTRIDGE

(75) Inventors: Hisashi Miyazawa, Nagano (JP); Munehide Kanaya, Nagano (JP); Yasuto Sakai, Nagano (JP); Masaki Shimomura, Nagano (JP); Satoshi Nakata, Nagano (JP); Yoshihiro Koizumi, Nagano (JP); Hiroshige Owaki, Nagano (JP); Takeo Seino, Nagano (JP); Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/058,659

(22) Filed: Feb. 15, 2005

(65) Prior Publication Data

US 2005/0146581 A1 Jul. 7, 2005

Related U.S. Application Data

(63) Continuation of application No. 10/116,499, filed on Apr. 3, 2002, now Pat. No. 6,955,422.

(30) Foreign Application Priority Data

| | | |
|---|---|---|
| Apr. 3, 2001 | (JP) | 2001-104526 |
| May 18, 2001 | (JP) | 2001-149315 |
| May 18, 2001 | (JP) | 2001-149788 |
| Aug. 31, 2001 | (JP) | 2001-264225 |

(51) Int. Cl.
*B41J 2/175* (2006.01)

(52) U.S. Cl. ..... 347/86

(58) Field of Classification Search ..... 347/37, 347/85–87, 86

See application file for complete search history.

(56) References Cited

U.S. PATENT DOCUMENTS 4,162,501 A 7/1979 Mitchell et al.

(Continued)

FOREIGN PATENT DOCUMENTS

DE 32 27 589 1/1984

(Continued)

OTHER PUBLICATIONS

English translation of Notification of Reason of Refusal in Japanese Pat. Appln. No. 2002-101358, dated Apr. 28, 2004.

(Continued)

*Primary Examiner*—An H. Do
(74) *Attorney, Agent, or Firm*—Stroock & Stroock & Lavan LLP

(57) ABSTRACT

An ink cartridge having a container for storing ink therein and having an ink supply port formed at a leading end side in an insertion direction of the container, a memory device disposed on a first of two opposite surfaces parallel to the insertion direction of the container, the memory device having an electrode for electrical connection to the recording device; a retaining member disposed on the first surface and located at a trailing end side relative to the memory device in the insertion direction, the retaining member serving to selectively engage with the recording device; and another retaining member disposed on the second surface and which also serves to selectively engage with the recording device.

75 Claims, 22 Drawing Sheets

U.S. PATENT DOCUMENTS

| | | | |
|---|---|---|---|
| 4,279,519 | A | 7/1981 | Shiurilz |
| 4,306,245 | A | 12/1981 | Kasugayama et al. |
| 4,368,478 | A | 1/1983 | Koto |
| 4,436,439 | A | 3/1984 | Koto |
| 4,447,820 | A | 5/1984 | Terasawa |
| 4,506,277 | A | 3/1985 | Terasawa |
| 4,629,164 | A | 12/1986 | Sommerville et al. |
| 4,633,274 | A | 12/1986 | Matsuda |
| 4,712,172 | A | 12/1987 | Kiyohara et al. |
| 4,771,295 | A | 9/1988 | Baker et al. |
| 4,907,018 | A | 3/1990 | Pinkerpell et al. |
| 4,929,109 | A | 5/1990 | Ikenaga |
| 4,961,088 | A | 10/1990 | Gilliland et al. |
| 4,990,938 | A | 2/1991 | Brandon et al. |
| 5,049,898 | A | 9/1991 | Arthur et al. |
| 5,137,379 | A | 8/1992 | Ukai et al. |
| 5,138,344 | A | 8/1992 | Ujita |
| 5,155,502 | A | 10/1992 | Kimura et al. |
| 5,208,610 | A | 5/1993 | Su et al. |
| 5,280,300 | A | 1/1994 | Fong et al. |
| 5,300,959 | A | 4/1994 | McClelland et al. |
| 5,317,339 | A | 5/1994 | Braun et al. |
| 5,359,357 | A | 10/1994 | Takagi et al. |
| 5,365,312 | A | 11/1994 | Hillmann et al. |
| 5,408,746 | A | 4/1995 | Thoman et al. |
| 5,410,641 | A | 4/1995 | Wakabayashi et al. |
| 5,411,343 | A | 5/1995 | Childers |
| 5,414,452 | A | 5/1995 | Accatino et al. |
| 5,461,482 | A | 10/1995 | Wilson et al. |
| 5,467,118 | A | 11/1995 | Gragg et al. |
| D365,596 | S | 12/1995 | Miyazawa et al. |
| 5,491,540 | A | 2/1996 | Hirst |
| D369,383 | S | 4/1996 | Miyazawa et al. |
| 5,506,611 | A | 4/1996 | Ujita et al. |
| 5,519,418 | A | 5/1996 | Nishikawa et al. |
| 5,528,269 | A | 6/1996 | Drogo et al. |
| 5,541,631 | A | 7/1996 | Hashimoto |
| 5,550,570 | A | 8/1996 | Kurata et al. |
| 5,610,635 | A | 3/1997 | Murray et al. |
| D378,760 | S | 4/1997 | Shinada et al. |
| 5,619,237 | A | 4/1997 | Inoue et al. |
| 5,623,293 | A | 4/1997 | Aoki |
| 5,633,666 | A | 5/1997 | Haigo |
| 5,640,186 | A | 6/1997 | Swanson et al. |
| D381,039 | S | 7/1997 | Shinada et al. |
| 5,646,660 | A | 7/1997 | Murray |
| 5,646,665 | A | 7/1997 | Swanson et al. |
| D382,296 | S | 8/1997 | Shinada et al. |
| 5,659,345 | A | 8/1997 | Altendorf |
| 5,666,146 | A | 9/1997 | Mochizuki et al. |
| 5,691,753 | A | 11/1997 | Hilton |
| 5,699,091 | A | 12/1997 | Bullock et al. |
| 5,706,040 | A | 1/1998 | Reid et al. |
| 5,710,585 | A | 1/1998 | Sabonis et al. |
| D390,598 | S | 2/1998 | Miyazawa et al. |
| 5,748,210 | A | 5/1998 | Watanabe et al. |
| 5,751,320 | A | 5/1998 | Scheffelin et al. |
| 5,786,828 | A | 7/1998 | Yamamoto |
| 5,788,388 | A | 8/1998 | Cowger et al. |
| 5,812,156 | A | 9/1998 | Bullock et al. |
| 5,835,817 | A | 11/1998 | Bullock et al. |
| 5,861,897 | A | 1/1999 | Ide et al. |
| 5,930,553 | A | 7/1999 | Hirst et al. |
| RE36,279 | E | 8/1999 | Ujita |
| 5,949,447 | A | 9/1999 | Arai et al. |
| 5,949,459 | A | 9/1999 | Gasvoda et al. |
| 5,956,057 | A | 9/1999 | Childers et al. |
| 5,975,677 | A | 11/1999 | Marler et al. |
| 5,992,975 | A | 11/1999 | Gasvoda, et al. |
| 6,011,937 | A | 1/2000 | Chaussade et al. |
| 6,017,118 | A | 1/2000 | Gasvoda et al. |
| 6,019,449 | A | 2/2000 | Bullock et al. |
| 6,019,461 | A | 2/2000 | Yoshimura et al. |
| 6,039,430 | A | 3/2000 | Helterline et al. |
| 6,042,211 | A | 3/2000 | Hudson et al. |
| 6,050,669 | A | 4/2000 | Yano et al. |
| 6,065,824 | A | 5/2000 | Bullock et al. |
| 6,074,042 | A | 6/2000 | Gasvoda et al. |
| 6,102,508 | A | 8/2000 | Cowger |
| 6,102,517 | A | 8/2000 | Kobayashi et al. |
| 6,109,723 | A | 8/2000 | Castle et al. |
| 6,126,265 | A | 10/2000 | Childers et al. |
| 6,130,695 | A | 10/2000 | Childers et al. |
| 6,137,503 | A | 10/2000 | Hashimoto, et al. |
| 6,155,678 | A | 12/2000 | Komplin et al. |
| 6,168,262 | B1 | 1/2001 | Clark et al. |
| 6,170,939 | B1 | 1/2001 | Ujita et al. |
| 6,170,940 | B1 | 1/2001 | Shinada et al. |
| 6,179,415 | B1 | 1/2001 | Okazaki et al. |
| 6,338,104 | B1 | 1/2001 | Iwasaki |
| 6,183,077 | B1 | 2/2001 | Hmelar et al. |
| 6,196,670 | B1 | 3/2001 | Saruta |
| D440,600 | S | 4/2001 | Seino et al. |
| 6,217,146 | B1 | 4/2001 | Takahashi et al. |
| 6,227,643 | B1 | 5/2001 | Purcell et al. |
| 6,231,173 | B1 | 5/2001 | Pawlowski, Jr. et al. |
| 6,276,780 | B1 | 8/2001 | Carrese et al. |
| 6,293,662 | B1 | 9/2001 | Shihoh et al. |
| 6,302,535 | B1 | 10/2001 | Sturgeon et al. |
| 6,312,073 | B1 | 11/2001 | Inora et al. |
| 6,312,088 | B1 | 11/2001 | Seino |
| 6,332,481 | B1 | 12/2001 | Shinada et al. |
| 6,361,136 | B1 | 3/2002 | Watanabe et al. |
| 6,361,138 | B1 | 3/2002 | Seino et al. |
| 6,371,586 | B1 | 4/2002 | Saruta |
| 6,375,298 | B2 | 4/2002 | Purcell et al. |
| 6,431,699 | B2 | 8/2002 | Shihoh et al. |
| 6,435,649 | B2 | 8/2002 | Takahashi et al. |
| 6,447,090 | B1 | 9/2002 | Saruta |
| 6,460,984 | B1 | 10/2002 | Matsumoto et al. |
| 6,476,926 | B1 | 11/2002 | Yano et al. |
| 6,481,829 | B1 | 11/2002 | Bailey et al. |
| 6,488,369 | B1 | 12/2002 | Steinmetz et al. |
| 6,494,559 | B1 | 12/2002 | Tsuji |
| 6,502,916 | B1 | 1/2003 | Naka |
| 6,502,917 | B1 | 1/2003 | Shinada et al. |
| 6,505,926 | B1 | 1/2003 | Trafton et al. |
| 6,565,198 | B2 | 5/2003 | Saruta |
| 6,588,871 | B2 | 7/2003 | Studholme et al. |
| 6,631,967 | B1 | 10/2003 | Saruta |
| 6,634,738 | B1 | 10/2003 | Shinada et al. |
| 6,722,762 | B2 | 4/2004 | Miyazawa et al. |
| 7,014,304 | B2 | 3/2006 | Sasaki |
| 7,019,857 | B2 | 3/2006 | Abe |
| 7,020,414 | B2 | 3/2006 | Ito et al. |
| 2002/0085051 | A1 | 7/2002 | Saruta |
| 2002/0085075 | A1 | 7/2002 | Shinada et al. |
| 2002/0180851 | A1 | 12/2002 | Saruta |
| 2002/0191038 | A1 | 12/2002 | Tsuji |
| 2002/0196302 | A1 | 12/2002 | Saruta |
| 2003/0007027 | A1 | 1/2003 | Saruta |
| 2003/0058297 | A1 | 3/2003 | Saruta |
| 2003/0197751 | A1 | 10/2003 | Saruta |
| 2004/0095407 | A1 | 5/2004 | Saruta |

FOREIGN PATENT DOCUMENTS

| | | |
|---|---|---|
| DE | 9116990.9 U | 1/1995 |
| EP | 0412459 | 2/1991 |
| EP | 0440261 | 8/1991 |
| EP | 0443245 | 8/1991 |
| EP | 0498117 | 8/1992 |
| EP | 0 622 208 A2 | 11/1994 |
| EP | 0 623 471 A2 | 11/1994 |

| | | | |
|---|---|---|---|
| EP | 0639462 | | 2/1995 |
| EP | 0 655 336 | | 5/1995 |
| EP | 0710568 | | 5/1996 |
| EP | 0713778 | | 5/1996 |
| EP | 0778145 | | 6/1997 |
| EP | 0778148 | | 6/1997 |
| EP | 0789322 | | 8/1997 |
| EP | 812 693 | A1 | 12/1997 |
| EP | 0822084 | | 2/1998 |
| EP | 0832747 | | 4/1998 |
| EP | 0839660 | | 5/1998 |
| EP | 0854043 | | 7/1998 |
| EP | 0854044 | | 7/1998 |
| EP | 0 860 284 | A2 | 8/1998 |
| EP | 0873873 | | 10/1998 |
| EP | 0 879 703 | | 11/1998 |
| EP | 0891865 | | 1/1999 |
| EP | 0940259 | A2 | 9/1999 |
| EP | 0940260 | | 9/1999 |
| EP | 0 956 958 | A2 | 11/1999 |
| EP | 0960736 | | 12/1999 |
| EP | 0963847 | | 12/1999 |
| EP | 0985537 | | 3/2000 |
| EP | 0 997 297 | A1 | 5/2000 |
| EP | 0999063 | | 5/2000 |
| EP | 1004449 | A2 | 5/2000 |
| EP | 1004451 | A2 | 5/2000 |
| EP | 1038682 | | 9/2000 |
| EP | 1066967 | A2 | 1/2001 |
| EP | 1080911 | A2 | 3/2001 |
| EP | 1080912 | A2 | 3/2001 |
| EP | 1080917 | | 3/2001 |
| EP | 1 114 726 | A1 | 7/2001 |
| EP | 1 122 076 | A1 | 8/2001 |
| EP | 1136268 | A1 | 9/2001 |
| EP | 1 219 438 | A2 | 7/2002 |
| EP | 1 247 651 | A2 | 10/2002 |
| GB | 2 303 824 | A | 3/1997 |
| GB | 2 326 378 | | 12/1998 |
| GB | 2350220 | A | 11/2000 |
| JP | 62-184856 | | 8/1987 |
| JP | 02-003321 | A | 1/1990 |
| JP | 02-099333 | | 4/1990 |
| JP | 02-279344 | | 11/1990 |
| JP | 03-067657 | | 3/1991 |
| JP | 03-227629 | | 10/1991 |
| JP | 04-500482 | T2 | 1/1992 |
| JP | 04-247955 | | 9/1992 |
| JP | 05-020275 | | 1/1993 |
| JP | 05-193127 | | 8/1993 |
| JP | 05-229137 | | 9/1993 |
| JP | 05-261935 | | 10/1993 |
| JP | 06-126981 | | 5/1994 |
| JP | 06-155758 | | 6/1994 |
| JP | 06-320750 | | 11/1994 |
| JP | 07-081077 | | 3/1995 |
| JP | 07-232438 | | 9/1995 |
| JP | 07-232439 | | 9/1995 |
| JP | 08-132635 | | 5/1996 |
| JP | 08-187854 | A | 7/1996 |
| JP | 08-197748 | A | 8/1996 |
| JP | 08-224885 | A | 9/1996 |
| JP | 8-230206 | A | 9/1996 |
| JP | 08-310007 | | 11/1996 |
| JP | 2594912 | | 12/1996 |
| JP | 09-001823 | A | 1/1997 |
| JP | 9-011500 | A | 1/1997 |
| JP | 09-174876 | | 7/1997 |
| JP | 09-174879 | | 7/1997 |
| JP | 9-193410 | | 7/1997 |
| JP | 09-314861 | A | 12/1997 |
| JP | 10-024607 | | 1/1998 |
| JP | 10-034965 | | 2/1998 |
| JP | 10-044451 | A | 2/1998 |
| JP | 10-217509 | A | 8/1998 |
| JP | 11-070665 | A | 3/1999 |
| JP | 2000-177145 | | 6/2000 |
| JP | 2000-301738 | | 10/2000 |
| JP | 2001-80089 | A | 3/2001 |
| JP | 2001-105587 | A | 4/2001 |
| WO | 90/00974 | | 2/1990 |
| WO | 96/05061 | | 2/1996 |
| WO | 96/40524 | | 12/1996 |
| WO | 97/23352 | | 7/1997 |
| WO | 98/52762 | | 11/1998 |
| WO | 98/55318 | | 12/1998 |
| WO | 98/55322 | | 12/1998 |
| WO | 98/55323 | | 12/1998 |
| WO | 98/55324 | | 12/1998 |
| WO | 98/55325 | | 12/1998 |
| WO | 99/59823 | A1 | 11/1999 |
| WO | 99/65695 | | 12/1999 |
| WO | 00/21756 | | 4/2000 |
| WO | 00/26034 | | 5/2000 |
| WO | 00/47417 | | 8/2000 |
| WO | 01/54910 | | 8/2001 |
| WO | 02/11986 | | 2/2002 |

OTHER PUBLICATIONS

German Language document "Date Up", cover, p. 11, two unnumbered pages, plus complete English translation, (publication date unknown).

German Language document "Date Up 98/1", cover, pp. 2-5, 22 and unnumbered pages, plus complete English translation, (publication date unknown).

Search Reports from EP 02007300.3-1251/ (Jul. 2, and Aug. 27, 2003).

U.S. Appl. No. 09/432,272, filed Nov. 2, 1999, Toshihisa Saruta.

U.S. Appl. No. 09/442,646, filed Nov. 18, 1999, Saruta.

U.S. Appl. No. 09/996,986, filed May 25, 1999, Toshihisa Saruta.

U.S. Appl. No. 09/318,268, filed May 25, 1999.

Office Action from Japanese Patent Application No. 2001-149788, dated Oct. 18, 2005.

Notice of Investigation of the U.S. International Trade Commission in the Matter of Certain Ink Cartridges and Components Thereof, Inv. No. 337-TA-565 (Mar. 17, 2006) (unsigned).

Respondent Ninestar Technology Co. Ltd.'s (Zhuhai) Third Supplemental Responses to Complainant's First and Second Sets of Interrogatories (Nos. 16-19. . . and 146) (including Exhibits A-C), U.S. ITC Investigation No. 337-TA-565 (Aug. 18, 2006).

Respondent Ninestar Technology Co., Ltd.'s Third Supplemental Responses to Complainant's First and Second Set of Interrogatories (Nos. 21-24. . . 138-145), U.S. ITC Investigation No. 337-TA-565 (Aug. 18, 2006).

Respondent Town Sky Inc.'s Third Supplemental Responses to Complainant's First and Second Set of Interrogatories (Nos. 21-24. . . 138-145), U.S. ITC Investigation No. 337-TA-565 (Aug. 18, 2006).

Respondent Dataproducts USA LLC's Second Supplemental Objections and Responses to Complainant's First Set of Interrogatories, U.S. ITC Investigation No. 337-TA-565 (Aug. 16, 2006).

Respondent Dataproducts USA LLC's Second Supplemental Objections and Responses to Complainant's Second Set of Interrogatories, U.S. ITC Investigation No. 337-TA-565 (Aug. 16, 2006).

Artech's Preliminary Proposed Claim Constructions, ITC Inv. No. 337-TA-565 (3 pgs.).

Artech's Preliminary Non-Infringement Claim Charts, ITC Inv. No. 337-TA-565 (18 pgs.).

Artech's Preliminary Invalidity Claim Charts, ITC Inv. No. 337-TA-565 (20 pgs.).

US 6,758,543, 07/2004, Matsumoto (withdrawn)

INK CARTRIDGE HAVING RETAINING STRUCTURE AND RECORDING APPARATUS FOR RECEIVING THE INK CARTRIDGE

CROSS-REFERENCE TO RELATED APPLICATION

This application is a continuation of application Ser. No. 10/116,499, filed on Apr. 3, 2002, now U.S. Pat. No. 6,955,422.

BACKGROUND OF THE INVENTION

The present invention relates to an ink cartridge for supplying ink, under a proper negative pressure state, to a recording head ejecting ink drops in response to printing signals.

A recording device, in which an ink container is mounted detachably in a carriage having an ink jet recording head, has a retaining mechanism that prevents removal or shifting of the cartridge due to motion of the carriage during printing operation, and that enables easy disengagement of the cartridge by an external operation.

For example, as disclosed in JP-A-10-44451, such a retaining mechanism is structured so that a protrusion portion to be engaged with an ink cartridge holder is formed on a first surface of opposite side surfaces of an ink tank, while a pawl is formed on a pivotable lever on a second surface. When the protrusion portion is brought into engagement with the ink cartridge holder, the pawl is brought into engagement with the ink cartridge holder by moving the other surface through rotation about the protrusion portion.

However, such a retaining mechanism, which mounts the ink cartridge by rotation of the cartridge, is difficult to employ in an ink container which forms an ink flow passage via an ink supply needle communicating with a recording head.

That is, because the ink supply needle has a predetermined length for ensuring reliable communication with the ink container, there is a danger that the ink supply needle may be bent or damaged when it is subjected to an external force in a direction other than the axial direction, such as rotation in the manner just described. Accordingly, the ink container has to be moved parallel to the longitudinal direction of the ink supply needle.

Further, as disclosed in JP-A-11500, an ink cartridge is proposed that has two elastically deformable levers respectively formed on two opposite surfaces of a container storing ink therein, each lever having a pawl for engagement with an ink cartridge holder, so as to enable insertion of the ink cartridge onto the ink supply needle.

Furthermore, as disclosed in JP-A-2001-105587, there is proposed an ink cartridge in the form of a thin and rectangular parallelepiped container for storing ink and having a latch member on a front-surface-side wall in the longitudinal direction, and protrusions for guiding the insertion of the cartridge that are formed on opposite walls in the vicinity of the front-surface-side wall.

However, an ink cartridge having a memory device that stores information concerning the ink cartridge or the like requires reliable connection to minute electrodes, and thus must be reliably positioned.

SUMMARY OF THE INVENTION

The present invention was made in view of the above-noted problems, and an object of the present invention is to provide an ink cartridge that is detachably joined to an ink supply needle inserted thereinto and that can be mounted in a manner which insures precise positioning of the ink cartridge to facilitate communication with the memory device provided in the cartridge.

Another object of the invention is to provide an ink cartridge, the capacity of which can be easily changed while using common component parts.

Still another object of the present invention is to provide an ink cartridge including: a container for storing ink therein and having an ink supply port in a leading end side in an insertion direction of the container; a memory device having an electrode connectable to a recording device, the electrode being disposed on one of the opposite surfaces parallel to the insertion direction of the container; and a retaining member disposed on the one surface and located at a trailing end side relative to the electrode in the insertion direction. The retaining member can be engaged to or disengaged from the recording device.

Yet another object of the present invention is to provide ink cartridges respectively storing different types of ink which can be mounted as a set in an ink jet recording device. Each ink cartridge includes a container body having an ink supply port and a cover member sealing an opened surface of the container body, wherein the ink supply ports, and members which cooperate with the ink jet recording device are disposed at the same positions with respect to side surfaces of the container bodies of the respective ink cartridges.

The present disclosure relates to the subject matter contained in Japanese patent application Nos. 2001-104526 (filed on Apr. 3, 2001), 2001-149315 (filed on May 18, 2001), 2001-149788 (filed on May 18, 2001) and 2001-264225 (filed on Aug. 31, 2001), which are expressly incorporated herein by reference in their entireties.

DESCRIPTION OF THE PREFERRED EMBODIMENT

The preferred embodiments of the present invention will be described below with reference to the accompanying drawings.

Figure 3:
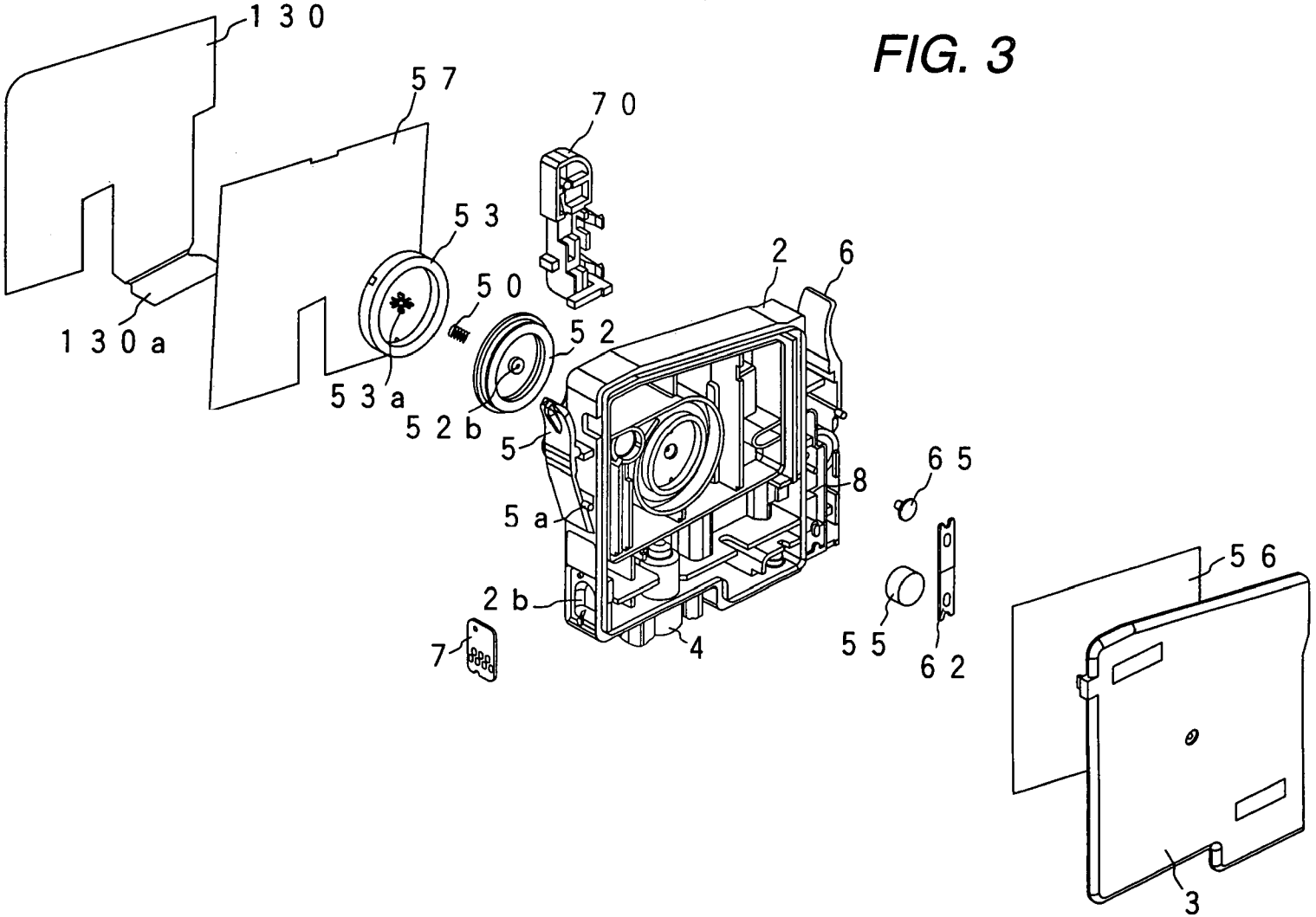
FIG. 3 is an exploded perspective view showing from one side assembly of an ink cartridge according to the embodiment.
Figure 4:
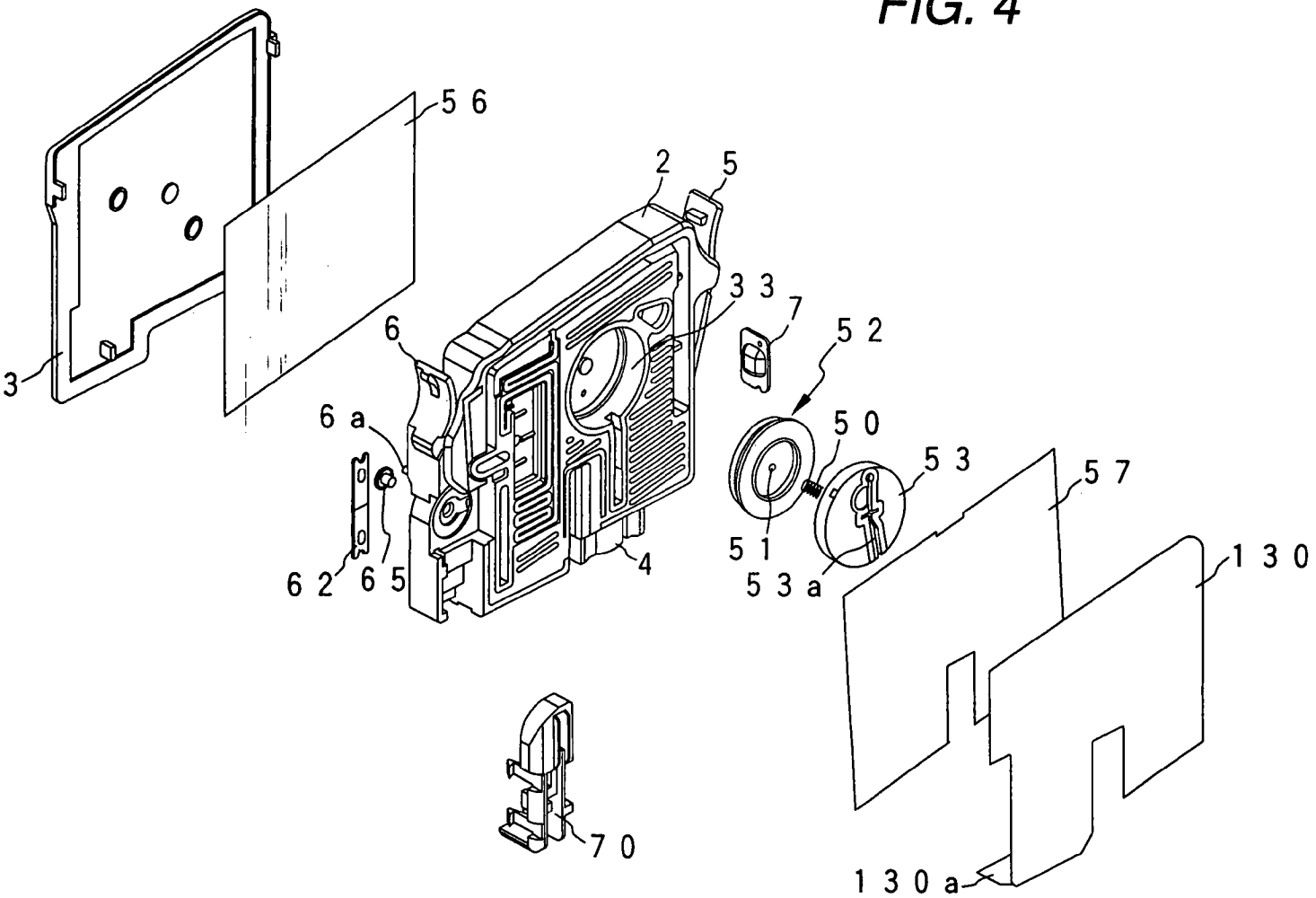
FIG. 4 is an exploded perspective view showing from the opposite side of that depicted in FIG. 5 the assembly of the ink cartridge according to the embodiment.

FIGS. 1A and 1B and FIGS. 2A to 2D show the exterior of an ink cartridge 1 according to an embodiment of the present invention. FIG. 3 and FIG. 4 are exploded perspective views showing assembly of the ink cartridge 1. The ink cartridge 1 includes a thin, rectangular container body 2 with a box-like shape that has an open first surface sealed by a cover member 3. An ink supply port 4 is formed at a leading end side (in the insertion direction) of the cartridge 1 (in this embodiment, on the bottom surface of the container body 2 at an offset position in the longitudinal direction of the container body 2). Retaining members 5 and 6 are integrally formed on the container body 2 at upper portions of the opposite walls which serve as a forward side and a rearward side respectively when the ink cartridge 1 is inserted or removed.

The retaining member 5 located closer to the ink supply port 4 is formed to have a pivot point or hinge at an insertion direction leading end portion (at a portion slightly above the lower end of the cartridge in this embodiment), and a movable upper potion that can be shifted outward. The other, opposite retaining member 6 is formed to assist in holding the cartridge together with the retaining member 5.

Each of these retaining members 5 and 6 has a width corresponding to the width of an insertion port provided in a carriage, so that the side surfaces of each retaining member 5, 6 serve as guide portions for regulating the position of the cartridge in the width direction.

Further, memory device 7 is provided under the retaining member 5 located closer to the ink supply port. The memory device 7 has electrodes 7*a* located on an exposed surface of a board, and which are arrayed into an upper row and a lower row, and a semiconductor memory element mounted on the rear surface of the board and connected to the electrodes 7*a*. A valve storage chamber 8 is formed under the other retaining member 6.

Figure 6A:
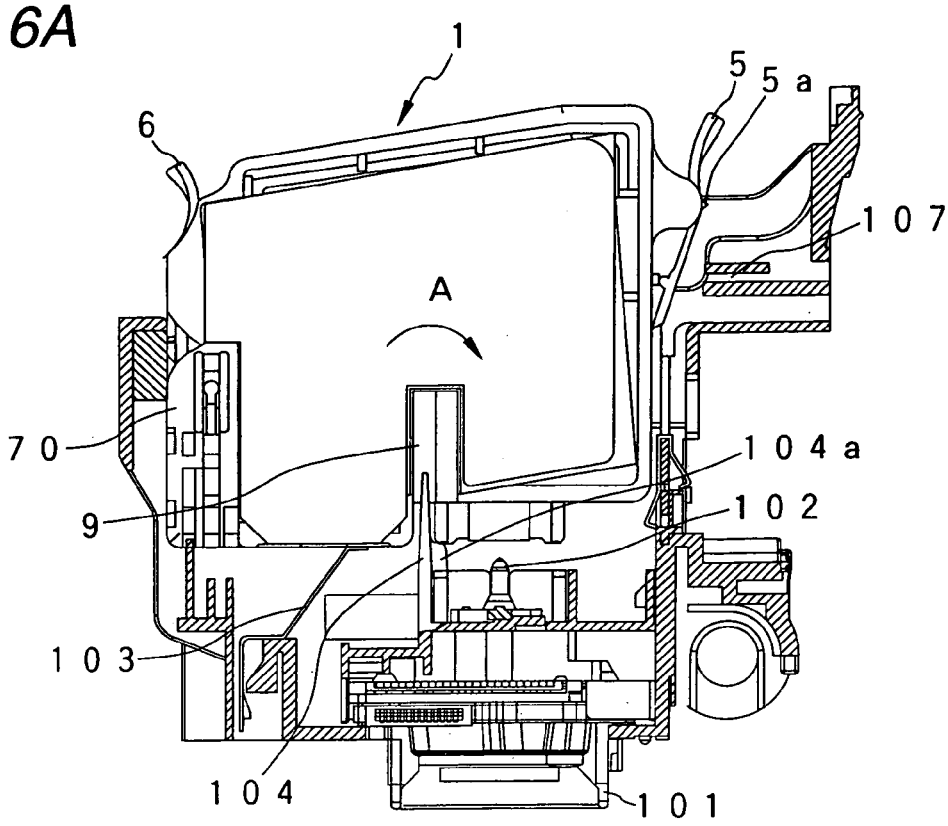
FIG. 6A and FIG. 6B are side cross-sectional views showing the process of mounting an ink cartridge in the carriage.

A slot 9 is formed in the vicinity of the ink supply port 4 and in a central region of the container so that the slot 9 extends from the leading end of the cartridge in the cartridge insertion/removal direction. The slot 9 has a length and width such as to guide the moving ink cartridge to orient the opened surface of the ink supply port 4 perpendicular to an ink supply needle 102 (shown in FIG. 6*a*) at least before the leading end of the ink supply port 4 reaches the ink supply needle of the carriage.

Figure 5:
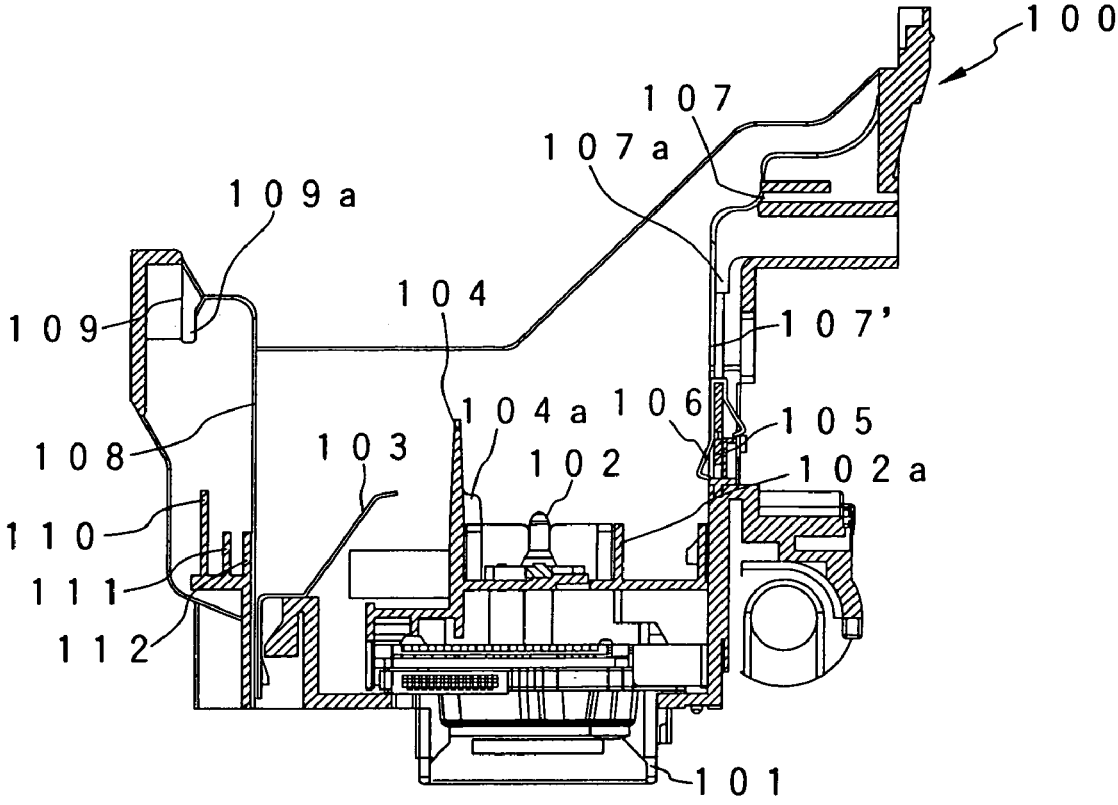
FIG. 5 is a sectional view showing a carriage for accommodating an ink cartridge, according to an embodiment of the invention.

With reference to FIG. 5, the carriage 100 onto which the cartridge is to be mounted has a recording head 101 disposed at the bottom of the carriage 100, and ink supply needles 102 communicating with the recording head 101, as shown in FIG. 5. An ink cartridge-pressing member (a leaf spring 103 in this embodiment) is disposed in a region separated from the region where the ink supply needle 102 is disposed, and a positioning protrusion 104 is formed between the ink supply needle 102 and the leaf spring 103 to extend in the insertion/removal direction of the cartridge. Also, electrodes 106 are disposed on a side wall 105 at the ink supply needle 102 side, and a recess 107 is formed in the upper portion of the side wall 105 so that the recess 107 will engage with a protrusion 5*a* of the retaining member 5.

Using the structure described above, as shown in FIG. 6A, when the cartridge 1 is inserted into the carriage with the ink supply port 4 located in the rear side and the cartridge 1 is pressed against the leaf spring 103, the slot 9 receives and guides downward movement of the ink cartridge 1 over the protrusion 104. Accordingly, even though a rotational force is applied to the cartridge 1 (in the direction of arrow A in FIG. 6A) by the leaf spring 103 disposed at an offset position in an attempt to move the ink supply port 4 side downward, the cartridge orientation is kept substantially parallel to the defined insertion/removal direction (the vertical direction in this embodiment).

Figure 6B:
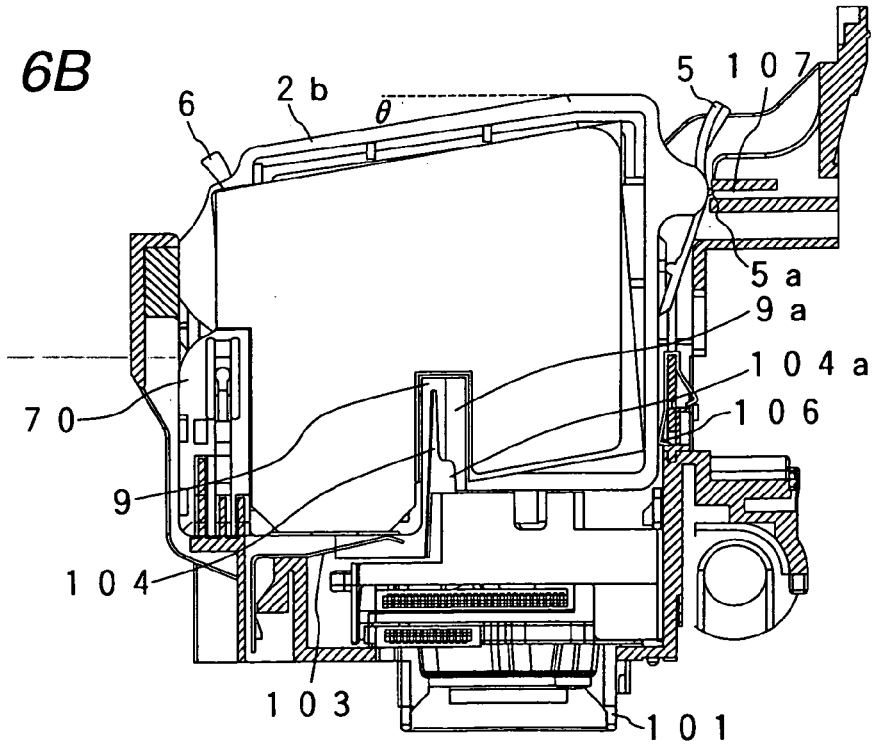

When the cartridge 1 is further urged against the leaf spring 103 by a finger pressing on the top surface 2*b* of the container body 2, the cartridge 1 is in part subjected to the horizontal component of the force exerted on the surface of the cartridge 1, where the memory device 7 is provided, so as to press against the electrodes 106 of the cartridge 100, because the top surface 2*b* of the container body 2 is formed as a slope at an upward angle θ relative to the rear side of the cartridge 1 (that is, the side beating retaining member 5). Thus, the electrodes 7*a* of the memory device 7 are brought into secure contact with the electrode 106, while the ink cartridge can be pressed onto and inserted over the ink supply needle 102. During the insertion process, as shown in FIG. 6B, the protrusion 5*a* of the retaining member 5 is subjected to the entire elasticity of the retaining member 5 and then falls into the recess 107 so that the protrusion 5*a* is engaged with the recess 107. Accordingly, a perceptible click is transmitted to the finger so that a user can feel when the cartridge has been securely mounted on the carriage 100.

Although the retaining member 6 may be provided with a protrusion similar to the protrusion 5*a* of the retaining member 5, providing the protrusion 5*a* only on the retaining member 5 at the memory device 7 side can prevent mounting failure of the ink cartridge. This is because, if a perceptible click is generated by the retaining member 6 at the opposite side from the side where the memory device 7 is provided, the user may erroneously conclude that the cartridge has been mounted properly even though the retaining member 5 located at the memory device 7 side has not yet been positioned, that is, though the retaining member 5 remains at a position where the perceptible click is not generated.

Once the cartridge has been mounted, owing to the position of the cartridge 1 in the insertion/removal direction being restricted by the protrusion 5*a* of the retaining member 5, and the surface of the cartridge 1 where the memory device 7 is provided being pressed against the electrodes 106 of the carriage 100 due to an urging force (a force in the direction of arrow A in FIG. 6A) exerted by the spring 103, secure contact between the cartridge 1 and the carriage 100 is maintained despite any vibrations generated during printing.

On the other hand, when the ink cartridge 1 is to be removed from the carriage 100 for replacement or the like, the retaining member 5 is pressed resiliently toward the container body 2 so that the retaining member 5 pivots about the portion slightly above the lower end as the point of rotation. Consequently, the protrusion 5*a* of the retaining member 5 is released from the recess 107. When the cartridge 1 is pulled out in this state, the cartridge 1 is guided by the protrusion (the guide piece) 104 and moves upward and parallel to the ink supply needle 102 owing to the urging force exerted by the leaf spring 103. Accordingly, the cartridge 1 can be removed from the carriage 100 without any bending force or the like be applied to the ink supply needle 102.

Figure 7:
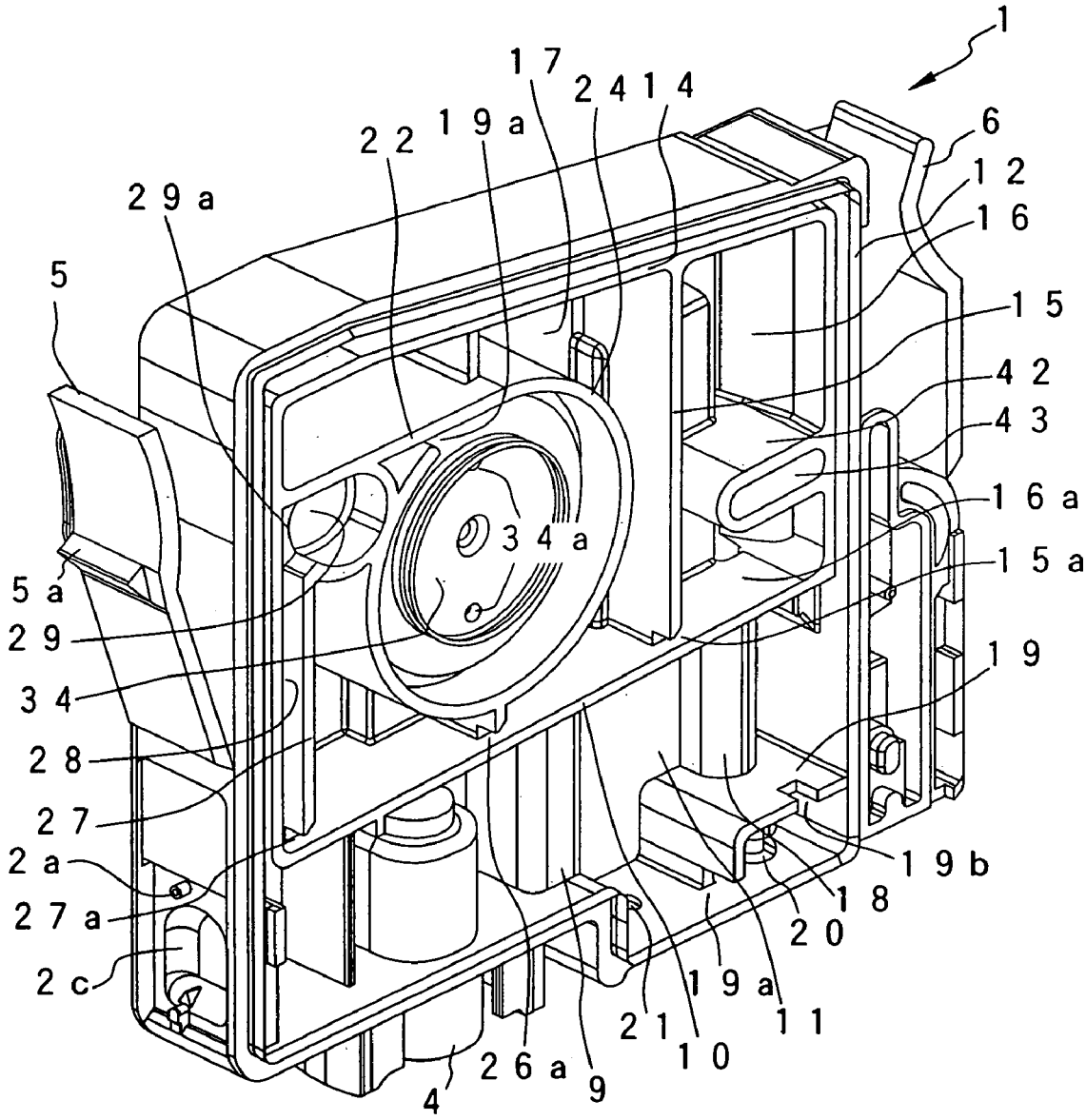
FIG. 7 is a perspective view showing, from a first side, the structure of the bottom of a container body forming the ink cartridge.
Figure 8:
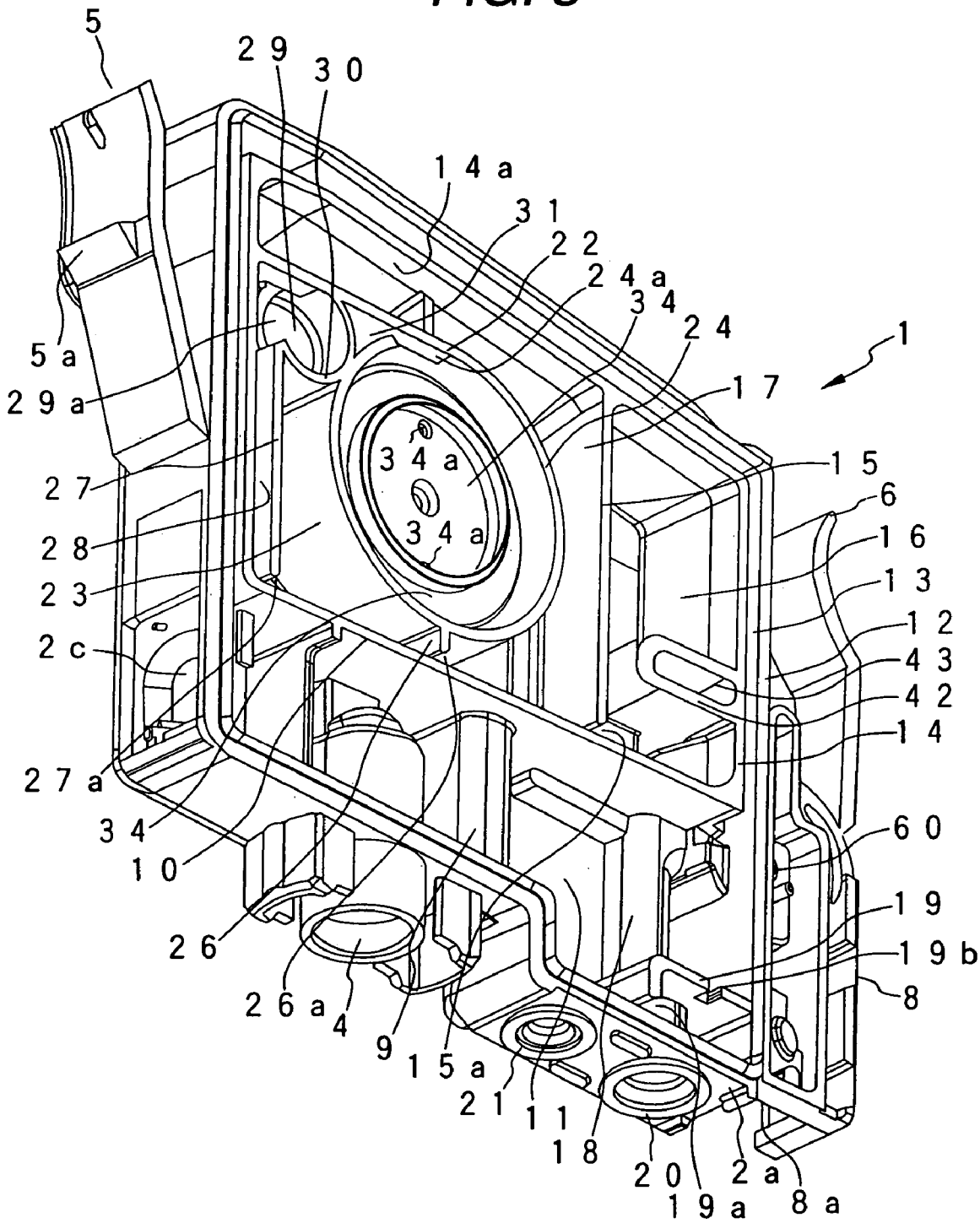
FIG. 8 is a perspective view showing from the opposite side of that depicted in FIG. 7 the structure of the opened surface of the container body forming the ink carriage.

FIG. 7 and FIG. 8 show an example of a flow path formed in the container body 2 which can be part of the above-mentioned ink cartridge. The container body 2 is partitioned into upper and lower sections by a wall 10 extending substantially horizontally.

The lower section contains a first ink chamber 11. The upper section is defined by a frame 14, with the wall 10 extending continuously as the upper section's bottom. A predetermined gap is formed by separating the frame 14 from a wall 12 of the container body 2 so that the gap forms an air communicating passage 13. The frame 14 is further divided into two sections by a vertical wall 15 and which are in fluid communication through a communication port 15*a* formed in the bottom portion of the frame 14. One of the two sections defines a second ink chamber 16, while the other defines a third ink chamber 17.

A suction passage 18 is formed in the section of the first ink chamber 11 below the second ink chamber 16, and the suction passage 18 connects a bottom 16*a* of the second ink chamber 16 to a bottom 2*a* of the container body 2. In this embodiment, the suction passage 18 is further configured such that a recessed portion 18*c* (FIG. 9A) is formed b the front of the container body 2, and the recessed portion 18*c* is sealed with an air impermeable film 57, as can be seen in FIGS. 3 and 4.

A wall 19 including communication ports 19*a* and 19*b* is formed by the lower portion of the suction passage 18. An injection hole 20 through which the container body 2 is filled with ink is formed at a portion generally opposing one end of the suction passage 18, while another hole 21 communicating with the first ink chamber 11 is formed parallel to the injection hole 20.

Figure 10:
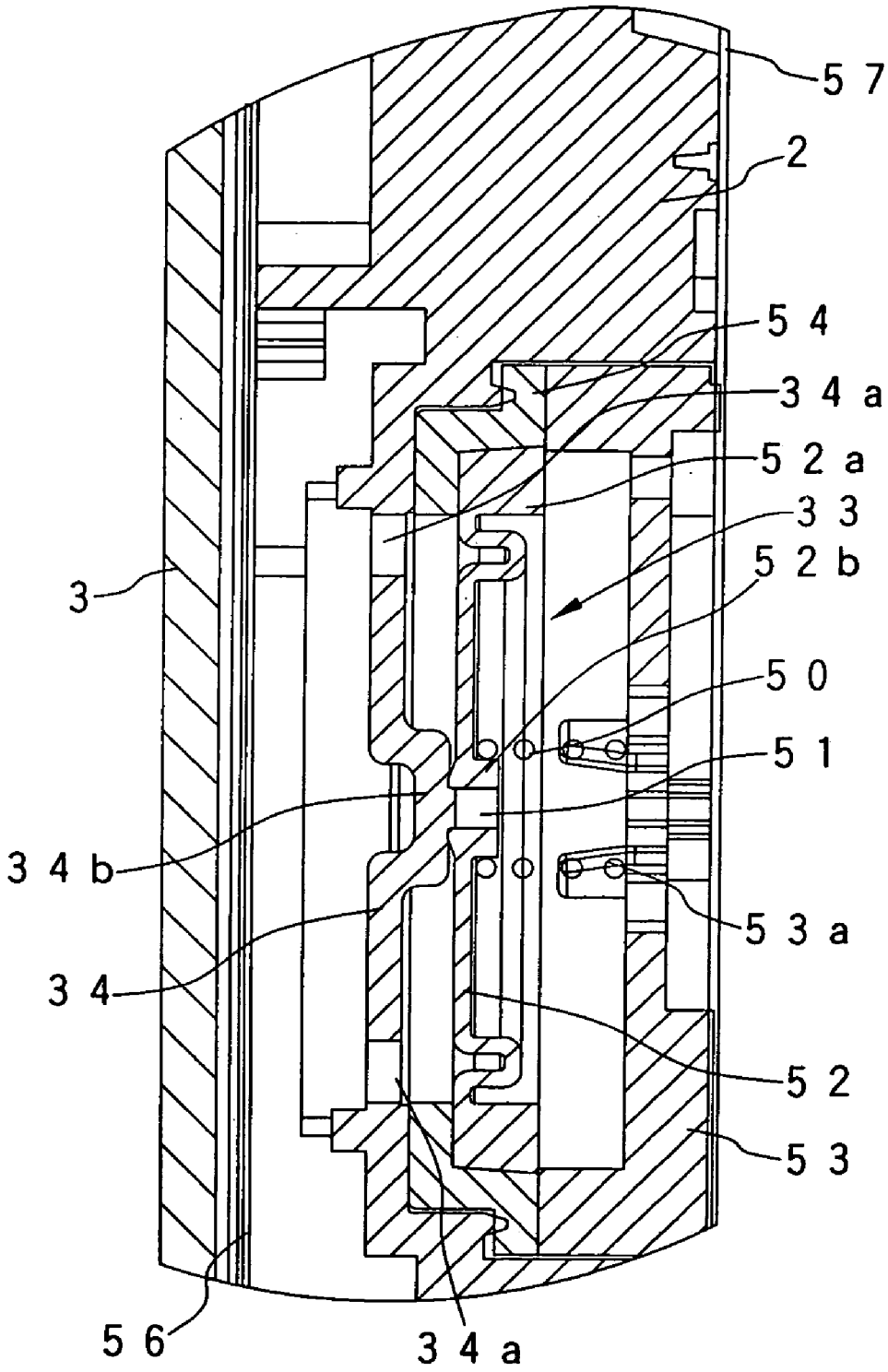
FIG. 10 is an enlarged, cross-sectional view showing the structure of a chamber storing a device for maintaining a negative-pressure.

The third ink chamber 17 is partitioned by walls 22, 24 and 26 and which are separated from an upper surface 14*a* of the frame 14 by a predetermined gap. A fourth ink chamber 23 is defined within the third ink chamber 14 by walls 10, 24, 26 and 27, and wall 24 defines a flow passage communicating with the rear surface of differential pressure valve storage chamber 33 (FIG. 10).

The partitioning wall 26 having a communication port 26*a* is provided between the lower portion of the wall 24 and the wall 10. The partitioning wall 27 having a communication port 27*a* at its lower portion is provided so that an ink passage 28 is formed between the partitioning wall 27 and the frame 14. The upper portion of the ink passage 28 communicates with the front surface side of the ink cartridge 1 via a through hole 29 which serves as a filter chamber. Filter 55 (FIG. 3), made of a porous material, is contained in through hole 29. In FIG. 8, reference numeral 2*c* indicates a recess for storing the memory device 7.

As shown in FIG. 8, through hole 29 is separated by a wall 30 continuous with wall 27, and communicates with the upper end of the ink passage 28 through a recess 29*a*, and also communicates, via a droplet-shaped recess 30*a* (FIG. 9A) provided in the front surface of the container body 2. Recess 24*a* is formed in an upper portion of the flow passage partitioned between a wall 34 located in the rear surface of the differential-pressure-valve storage chamber 33, and the wall 24.

Figure 9A:
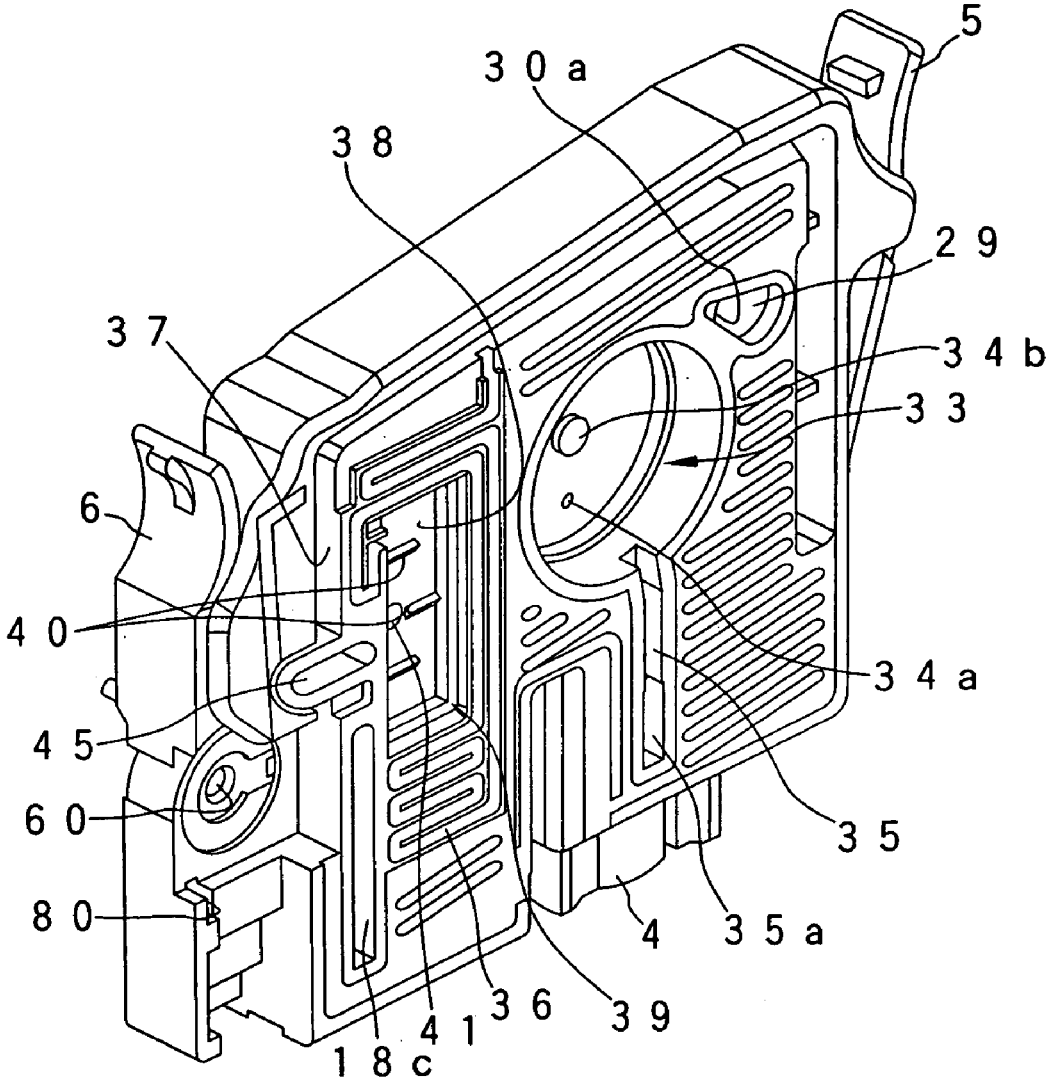
FIG. 9A is a perspective view showing the structure of the front surface of the container body forming the ink cartridge.

Turning now to FIG. 9A, the lower portion of the differential-pressure-valve storage chamber 33 and the ink supply port 4 are connected to each other by a flow passage that is defined by a recess 35 formed in the front surface of the container body 2 and the air impermeable film 57 (FIG. 10) covering that recess 35.

Figure 9B:
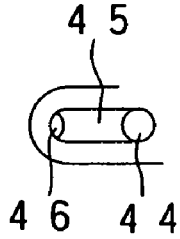
FIG. 9B is a view showing a through hole formed in a groove for communication.

With continued reference to FIG. 9A, a narrow groove 36, a wide groove 37 and a recess 38 a reformed in the front surface of the container body 2. The narrow groove 36 meanders so as to provide a large flow resistance. The wide groove 37 is disposed around the narrow groove 36. The recess 38 is preferably rectangular in shape and disposed in an area opposite to the second ink chamber 16. A frame 39 and ribs 40 are formed in the rectangular recess 38 and are slightly lower in height than the open surface of the rectangular recess 38. An air permeable film (not shown) which is both ink repellent and air permeable is stretched and bonded to these frame 39 and ribs 40 to form an air communication chamber. A through hole 41 is formed at the floor of the recess 38, and communicates with a slender region 43 (FIG. 7) defined by a wall 42 of the second ink chamber 16. The narrow groove 36 communicates with the recess 38 at a position closer to the front surface side than the air permeable film. As shown in FIG. 9B, the other end of the slender region 43 communicates with the valve storage chamber 8 via a through hole 44, a communicating groove 45 and a through hole 46.

A window 8*a*is formed and opened in the leading end of the valve storage chamber 8 in the cartridge insertion direction (in the lower portion of the valve storage chamber 8 in the embodiment depicted in FIG. 8) so that a cartridge-identifying block 70 (as shown in FIGS. 3, 4 and 12) can be mounted, and the cartridge-identifying block 70 will be described later. The cartridge-identifying block 70 permits insertion of a valve operating rod and a plurality of identifying pieces 110, 111 and 112 (shown in FIG. 5) which are provided on the carriage 100 of the recording device body.

FIG. 10 is a cross-sectional view showing structure in the vicinity of the differential-pressure-valve storage chamber 33. A spring 50 and a membrane valve 52 are contained in the differential-pressure-valve storage chamber 33. The membrane valve 52 is preferably formed from elastically deformable material, such as elastomer, and has a through hole 51 at its center. The membrane valve 52 includes an annular thick portion 52*a* about its circumference, and a frame 54 is formed integrally with the thick portion 52*a*. The membrane value 52 is fixed in the container body 2 via the frame 54. The spring 50 is supported at one end by a spring receiving portion 52*b* of the membrane valve 52, and at the other end by a spring receiving portion 53*a* of a lid member 53, which is fitted to the opening of the storage chamber 33.

Reference numerals 56 and 57 represent air impermeable films bonded onto the front surface side and the opened surface side of the container body 2. The air impermeable film 56 is bonded to the wall 10, the frame 14 and the walls 15, 22, 24, 26, 27, 30 and 42 (FIG. 7) by welding or the like. The air impermeable film 57 is bonded to cover the narrow groove 36 formed in the front surface of the container body 2 and the differential-pressure-valve storage chamber 33.

In this structure, ink which has passed through ink passing ports 34*a* is blocked by the membrane valve 52. Then, when the pressure at the ink supply port 4 is reduced because of that pressure differential, the membrane valve 52 separates from the valve seat 34*b*, despite the urging force exerted by the spring 50, so that the ink passes through the through hole 51 and flows to the ink supply port 4 via the flow passage formed by the recess 35.

When the ink pressure at the ink supply port 4 increases to a predetermined value, the membrane valve 52 is brought back into resilient contact with the valve seat 34*b* under the urging force of the spring 50. As a result, the ink flow is interrupted. Through the periodic repetition of this operation, ink is discharged to the ink supply port, while a constant negative pressure is maintained.

Figure 11:
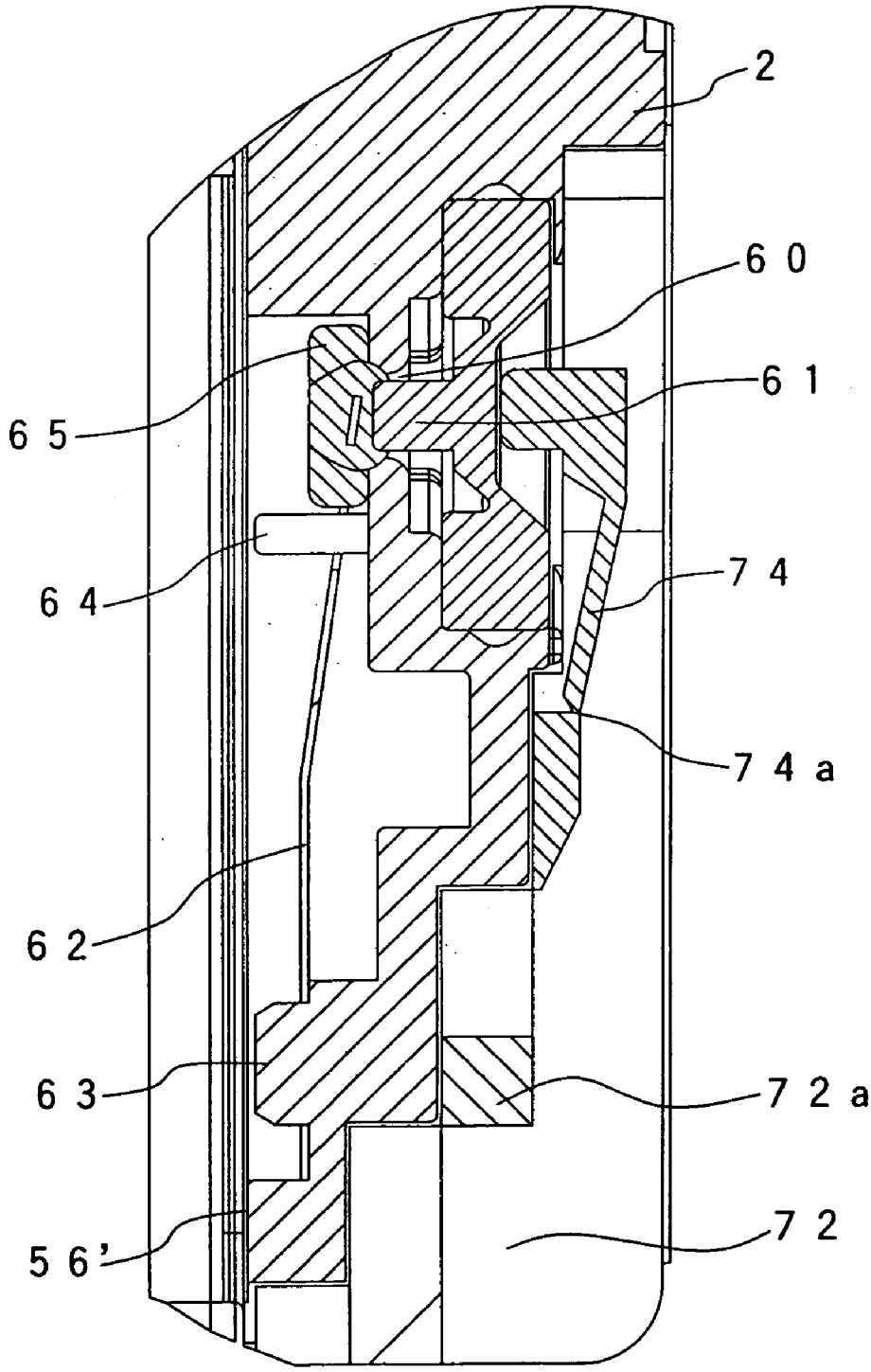
FIG. 11 is an enlarged cross-sectional view showing the structure of an air communication valve storage chamber.

FIG. 11 is a sectional view showing the structure of the valve storage chamber 8 for communication with the air. A through hole 60 is formed in the wall defining the valve storage chamber 8. A pressing member 61 formed from elastic material, such as rubber, is movably inserted into the through hole 60 in a state that the circumference of the pressing member 61 is supported by the container body 2. A valve body 65 is provided at the leading end of the pressing member 61 in the insertion direction, and the valve body 65 is movably supported by an elastic member 62, such as a leaf spring, having a lower end secured to a protrusion 63 and an intermediate portion guided by a protrusion 64. The valve body 65 is constantly urged by elastic member 61 toward the through hole 60.

Figure 12A:
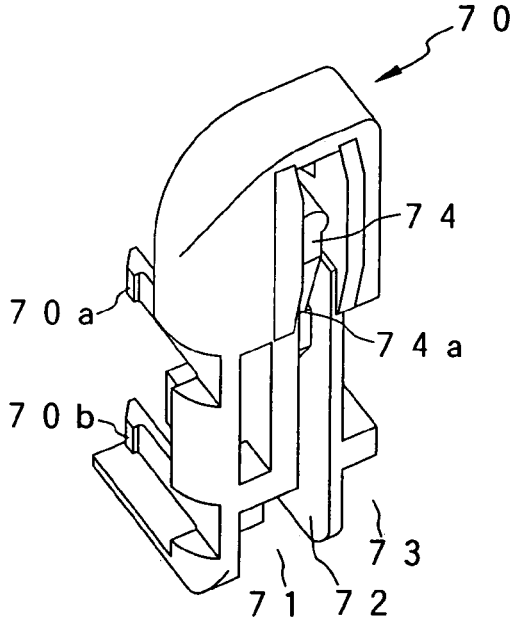
FIG. 12A and FIG. 12B are a perspective view and a front view, respectively, showing an example of a cartridge-identifying block.

The cartridge-identifying block 70 shown in FIGS. 12A and B is located and installed by the other surface of the pressing member 61.

Figure 12B:
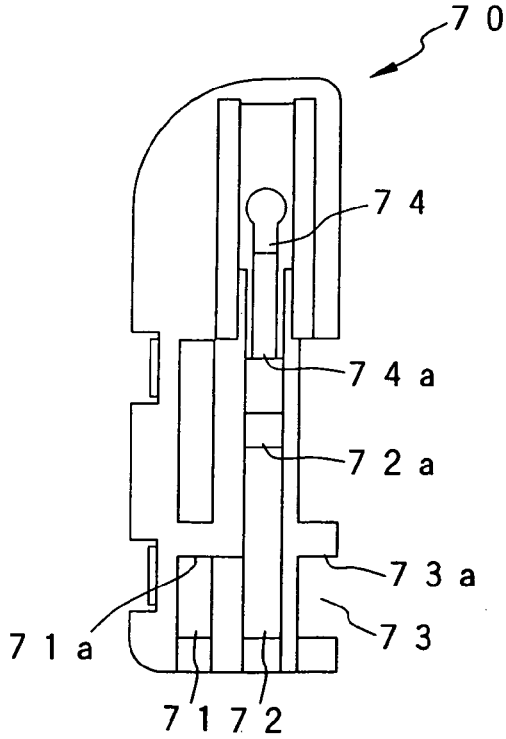

The cartridge-identifying block 70 has a base which is fixed to a recess 80 of the cartridge (FIG. 9A) and another recess not shown) using pawls 70*a* and 70*b*. As shown in FIGS. 12A and 12B, the base is formed with a plurality of grooves (three grooves 71, 72 and 73 in the embodiment), and an arm 74. Each of these grooves 71, 72 and 73 extends parallel to the cartridge insertion direction and has a predetermined width in the widthwise direction of the cartridge. In this embodiment, the arm 74 is provided in line with the groove 72 on the ink cartridge insertion side (the trailing end of the insertion direction in the embodiment) for pressing against the pressing member 61 as shown in FIG. 11. Depths of these grooves 71, 72 and 73 can be set so that the grooves 71, 72 and 73 can receive respective identifying pieces such as pieces 110, 111 and 112, shown in FIG. 5.

Figure 14:
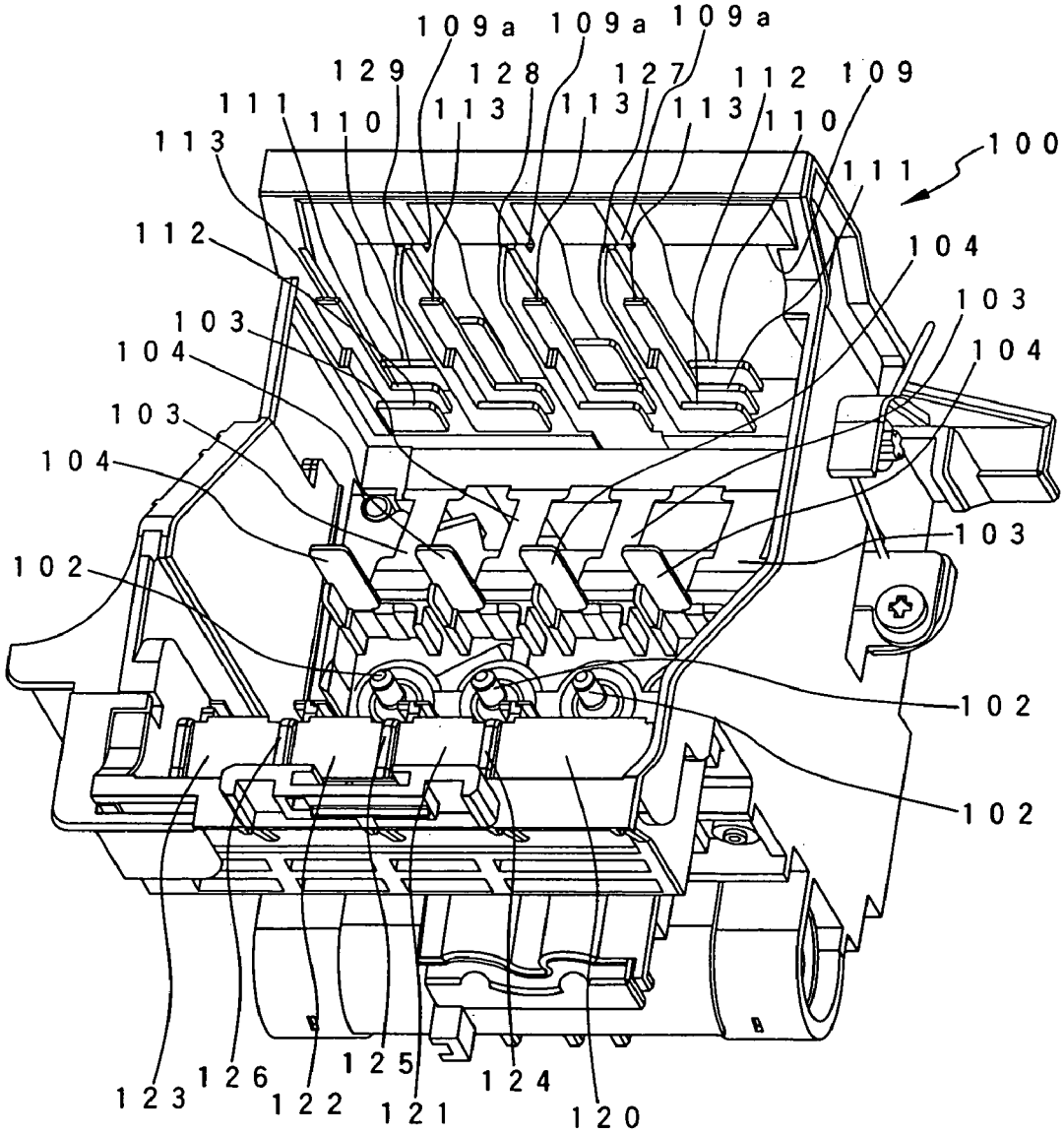
FIG. 14 is a perspective view showing the carriage of FIG. 13 viewed from a different direction.

The arm 74 is pivotable about a pivot or hinge 74*a* so as to be located further inwardly, and has a pull-out side (the leading end portion of the arm 74 in the insertion direction in this embodiment) that protrudes obliquely into the insertion path of an operating rod 113 (FIG. 14).

Further, as shown in FIGS. 12A and 12B, protruding portions 71*a*, 72*a* and 73*a* are formed in the respective grooves 71, 72 and 73 so as to face the upper end of identifying pieces 110, 111 and 112 of the carriage 110 respectively.

In the structure as described above, while the position of the arm 74 is fixed, the positions of the protruding portions 71*a*, 72*a* and 73*a* for engagement and the positions of the upper ends of the corresponding identifying pieces 110, 111 and 112 can be set in accordance with the kind of ink contained in the cartridge. Accordingly, it is possible to prevent the cartridge from being mounted erroneously. If the positions of the protruding portion 71*a*, 72*a* and 73*a* for engagement can be changed not only in the insertion direction of the cartridge but also in the width direction of the cartridge, it is made possible to adopt a three-dimensional layout structure for the protruding portions 71*a*, 72*a* and 73*a* for engagement. In that case, it becomes possible to identify a large number of kinds of ink without increasing the size of the identifying region.

Figure 13:
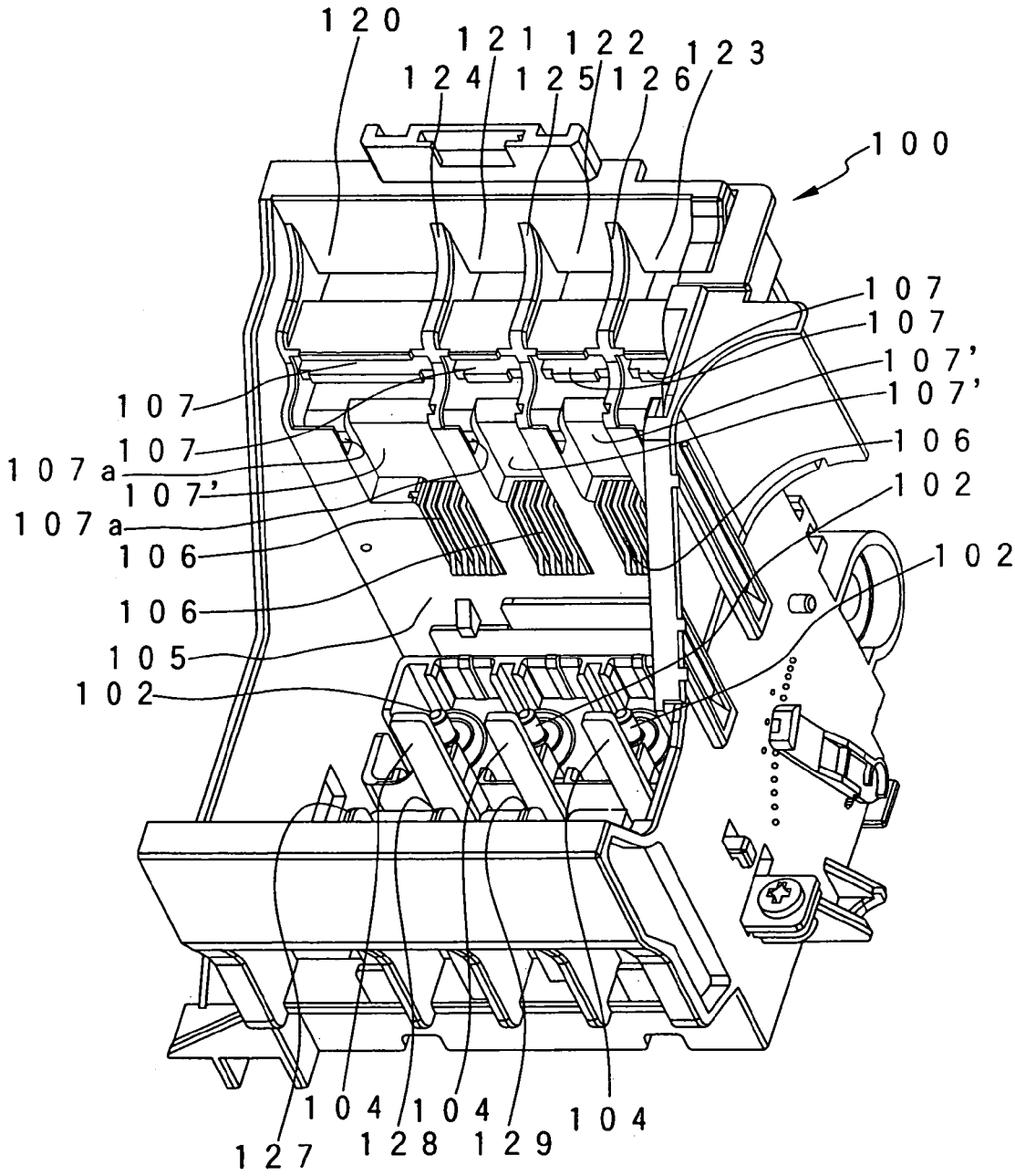
FIG. 13 is a perspective view showing an example of a carriage constructed so that plural ink cartridges can be stored in the carriage.

FIGS. 13 and 14 show an embodiment of a carriage in which the ink cartridges are mounted. The carriage is constructed so that a plurality of ink cartridges (one black ink cartridge and three color ink cartridges in this embodiment) may be mounted in the carriage.

That is, a first mounting region 120, which is somewhat wider than others, is disposed at one side. Second, third and fourth mounting regions 121, 122 and 123, which are equal in width, are defined in part by ribs 124, 125 and 126 and opposed ribs 127, 128 and 129 and are adjacent to the first mounting region 120.

As described with reference to FIG. 5, each cartridge mounting region has an ink supply needle 102 communicating with the recording head 101, a pressing member (the leaf spring 103 in this embodiment) in a region separated from a region where the ink supply needle 102 is disposed, and a positioning protrusion 104 provided between the leaf spring 103 and the ink supply needle 102 to shift in the cartridge insertion/removal direction. Further, a recess 107' is formed to guide the side portions of the ink cartridge at the retaining member 5 side.

Further, the electrodes 106 are disposed on a side wall 105 close to the ink supply needle 102. Recess 107 is formed by the upper portion of the side wall 105 to engage the protrusion 5*a* of the retaining member 5. A recess 107*a* is formed in the vicinity of recess 107 to engage a protrusion 5*b* of the retaining member 5 extending from the side portion of the retaining member 5.

Similarly, a region that contacts the retaining member 6 is formed with a recess 109 for guiding side portions of the retaining member 6, and a recess 109*a* engaged with a protrusion 6*b* of the retaining member 6 extending from the side portion of the retaining member 6.

Figure 15A:
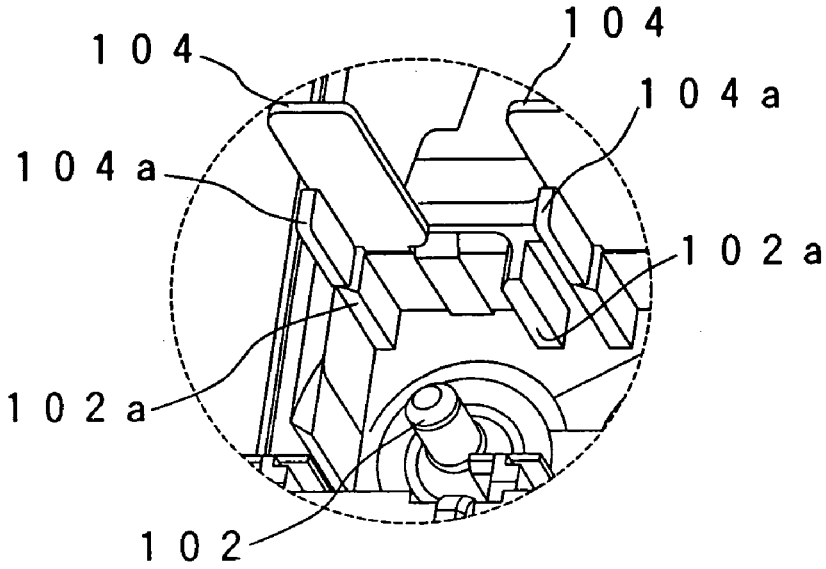
FIG. 15A and FIG. 15B are enlarged views showing the vicinity of an ink supply needle of the carriage and the vicinity of an ink supply port of the ink cartridge, respectively.
Figure 15B:
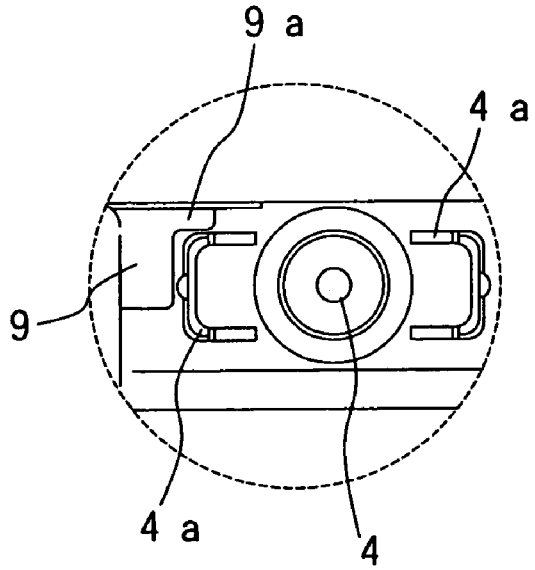

In the embodiment, the positioning protrusion 104 is constructed so that, as shown in FIG. 15A, side portions 104*a* extend parallel to the front surface of the cartridge to ensure reliable positioning and the strength of the thin and long protrusions 104. Corresponding to the positioning protrusions 104, as shown in FIG. 15B, the slot 9 of the ink cartridge is constructed so that the cartridge insertion direction leading end thereof has a recess 9*a* opposing the side portion 104*a*, the recess 9*a* being open to the front surface side of the ink cartridge.

Returning to FIGS. 15A and 15B, ribs 102*a* are brought into engagement with U-shaped ribs 4*a* and between which U-shaped ribs 4*a* the ink support port 4 of the ink cartridge is sandwiched. Ribs 102*a* are formed around the circumference of the ink supply needle 102. By these ribs 102*a*, it is possible to maintain the cartridge in a state that the ink supply needle 102 is inserted into the ink supply port 4.

Figure 16A:
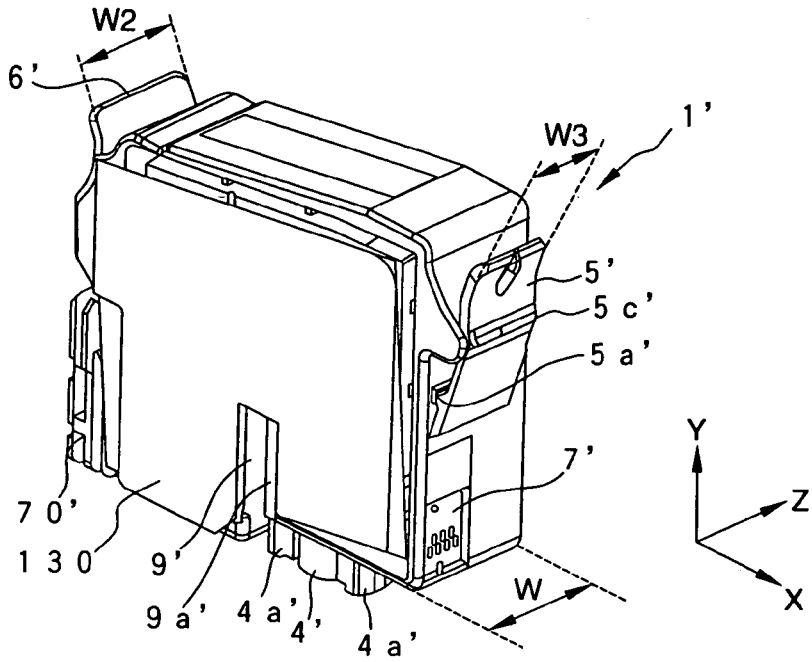
FIG. 16A to FIG. 16C are perspective views and a bottom view, respectively, showing a large-capacity ink cartridge according to an embodiment of the present invention.
Figure 16B:
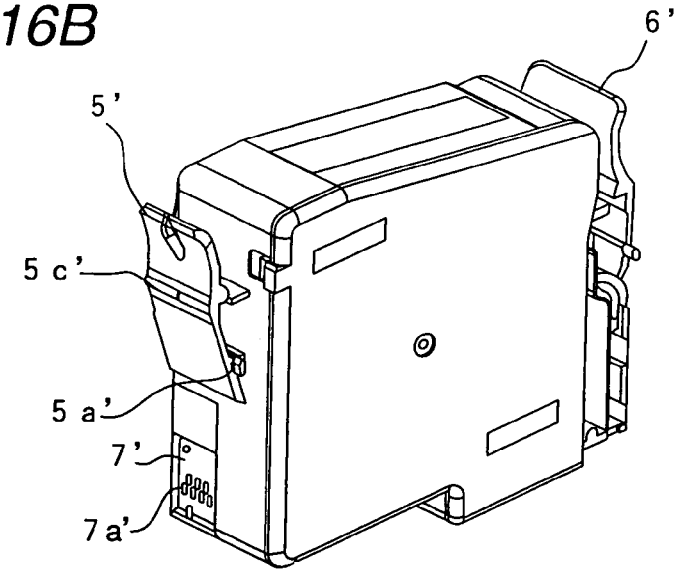
Figure 16C:
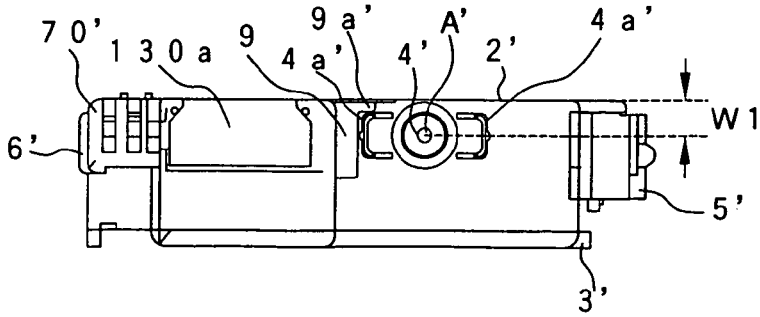

The large-capacity ink cartridge mounted in the wide first mounting region 120 generally has the same structure as that just discussed (the small-capacity ink cartridge is shown in FIGS. 1 and 2), as depicted in FIGS. 16A to 16C. A container body 2' is configured to have an opened surface having the same shape as that of the container body 2, but the depth W thereof is greater than that of the container body 2. Accordingly, by altering the depth W of the container body 2', the ink capacity of the container body 2' can be increased. Incidentally, in FIGS. 16A and 16B, the members that have the same function as those shown in FIG. 1 and FIG. 2 are numbered correspondingly but marked with a prime.

Layout centers of an ink supply port 4' and memory device 7', particularly, the array of electrodes 7*a'* of the memory device 7', are located at a predetermined position W1 from the surface of the container body 2', that is, the bottom, in the same manner as the other cartridges. More specifically, the distance W1 of the layout center of the ink supply port 4' from the surface of the container body 2' in the large capacity ink cartridge 1' is equal to the distance W1 of the layout center of the ink supply port 4 from the surface of the container body 2 in the small capacity ink cartridge 1. Similarly, the distance WI between the layout center of the electrodes 7*a'* and the surface of the container body 2' in the large capacity ink cartridge 1' is set to be equal to the distance W1, shown in FIG. 2D, between the layout center of the electrodes 7*a* and the surface of the container body 2 in the small capacity ink cartridge 1. In addition, a cartridge-identifying block 70' is mounted on the container body 2' at the surface side. Accordingly, the cartridge-identifying block 70' is disposed at the same position as in the other cartridges.

Retaining member 5' and 6' are disposed at offset positions from the surface of the container body 2' in the same manner as the ink supply port 4' so as to surely apply a pressing force to the ink supply port 4' when the cartridge is mounted. In addition, as shown in FIG. 16A, a width W2 of the retaining member 6', to be located closer to a user when the user mounts or removes the ink cartridge 1' to the carriage, is preferably larger than a width W3 of the retaining member 51 in view of operationability. That is, the width W2 of the retaining member 61 on which the user's thumb is placed is preferably larger than the width W3 of the retaining member 5' on which the user's forefinger is placed.

Figure 17A:
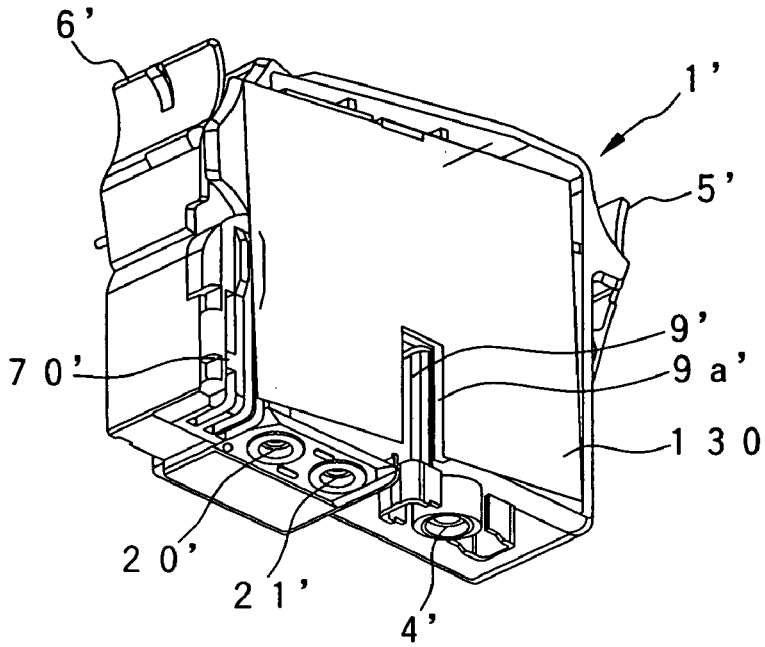
FIG. 17A and FIG. 17B are rear and front perspective views, respectively, showing the structure of the ink injection holes of the large capacity ink cartridge.
Figure 17B:
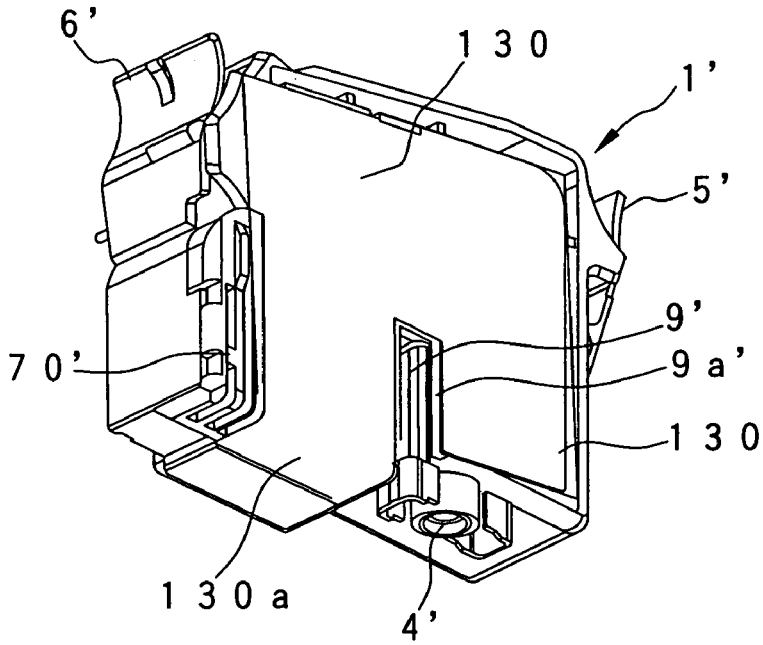

As shown in FIG. 17B, a tongue portion 130*a* may be formed integrally with a decorative film 130 bonded to the surface of the film 57' of the container body 2' so that the tongue portion 130*a* corresponds in position to ink injection holes 20' and 21' (shown in FIG. 17A) and seals the ink injection holes 20' and 21'.

Figure 18:
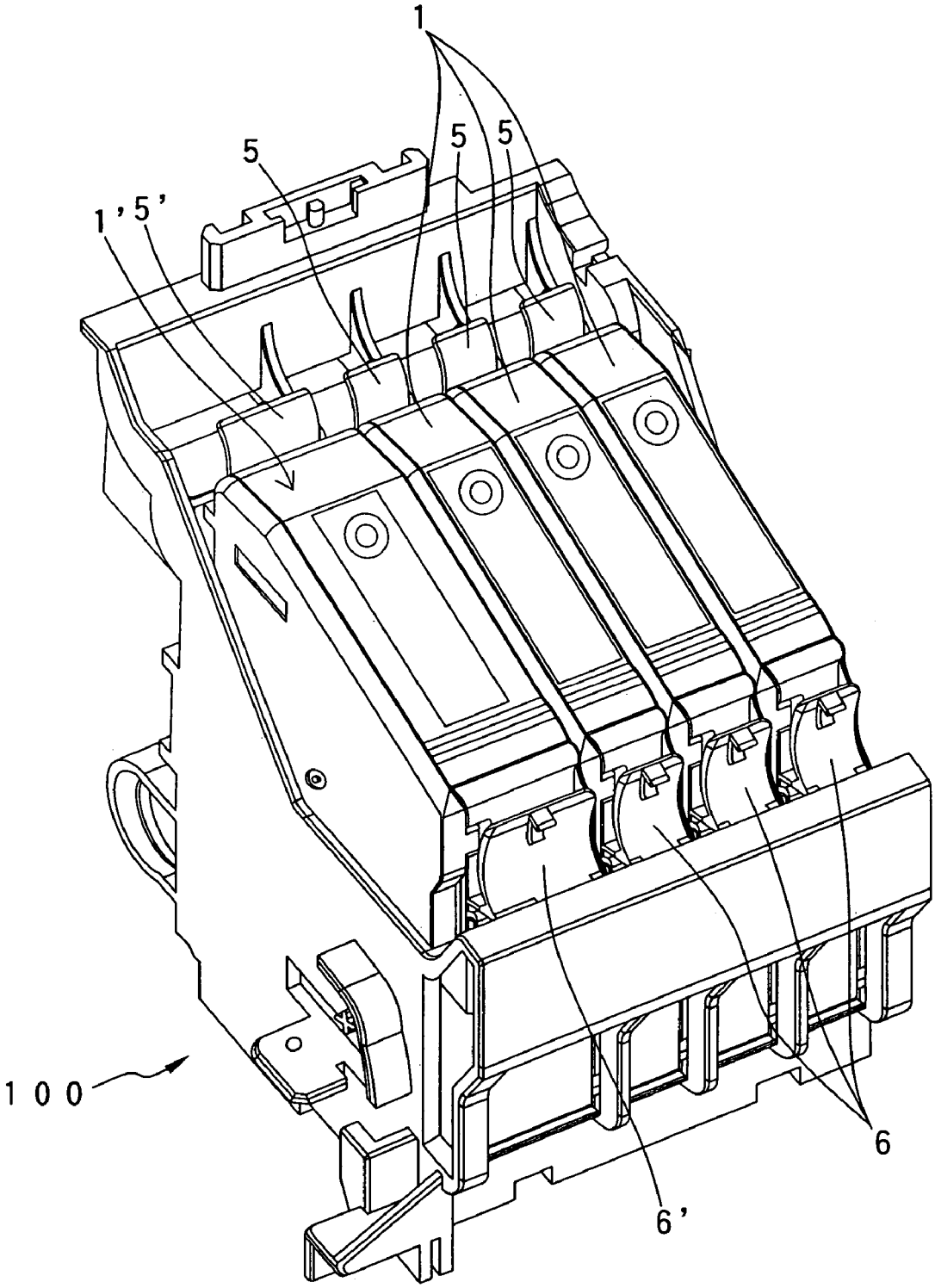
FIG. 18 is a perspective view showing both large-and small-capacity ink cartridges mounted on the carriage.

FIG. 18 shows the small-capacity ink cartridges 1 and the large-capacity ink cartridge 1' described above as mounted on the cartridge 100.

In the above-described embodiment, a differential-pressure valve is used as negative pressure generating device. However, it is apparent that the same effect can be also obtained by using a porous material such as a sponge impregnated with ink so as to maintain the negative pressure by means of the capillary force of pores.

Also, in the above-described embodiment, the plural ink cartridges are mounted on a carriage. Alternatively, plural carriages could be provided, with one or more cartridge(s) being mounted on each of the plural carriages.

As described above, according to the present invention, it is possible to provide an ink cartridge that is detachably connectable to an ink supply needle and that can be mounted with precise positioning so that communication with the cartridge's memory device can be ensured. Also, it is possible to provide an ink cartridge, the capacity of which can be easily changed while using common component parts.

As described above, the present invention provides, at least, the following arrangements:

(1) An ink cartridge comprising: a container body having a first wall; at least one electrode connected to a memory device, the at least one electrode being fixed relative to the wall; and an engagement portion movable relative to the wall and being higher in a Y-axis direction than the at least one electrode.

Figure 2A:
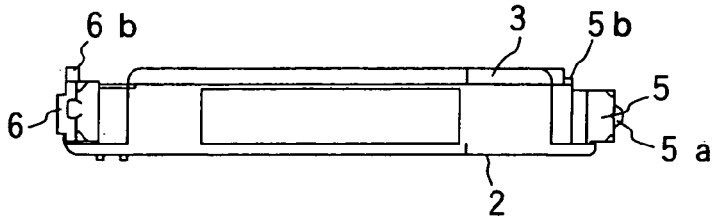
FIGS. 2A to 2D are top, front, bottom and side views, respectively, of the ink cartridge.
Figure 2B:
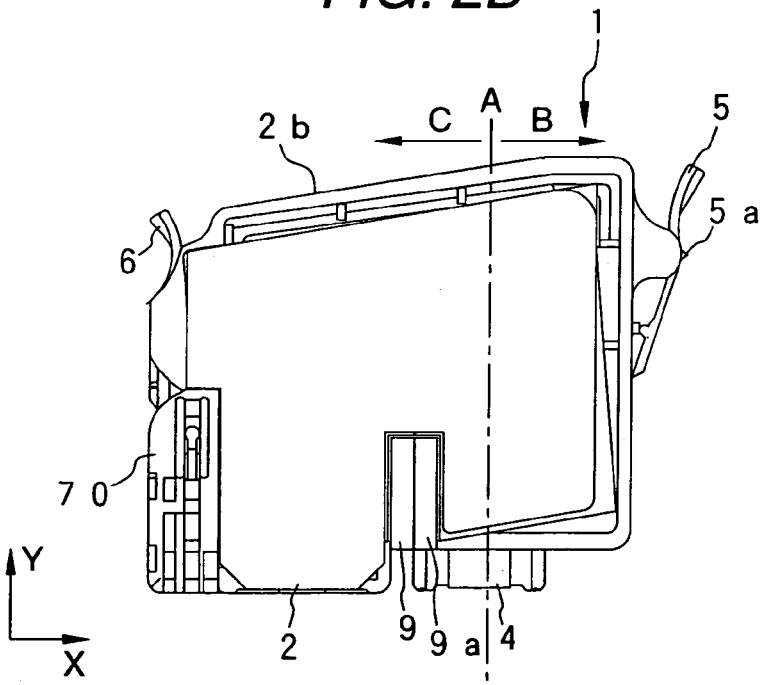
Figure 2C:
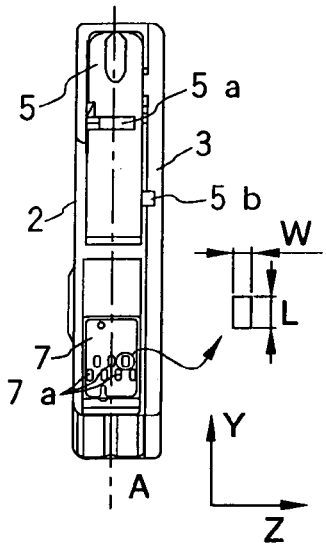
Figure 2D:
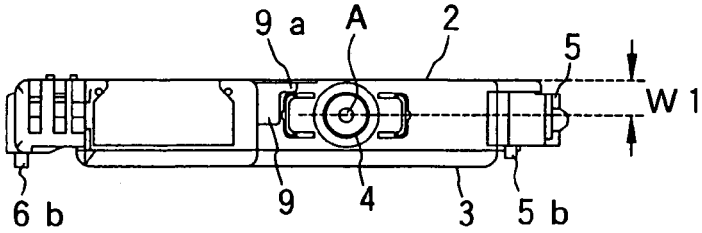

By way of not-limiting example, as shown in FIG. 2*c*, a movable engagement protrusion 5*a* is higher in a Y-axis direction than the electrodes 7*a*. In this embodiment shown in FIG. 2A to 2C, the movable engagement portion is in the form of the protrusion 5*a* which is formed on the retaining member 5 in the form of a pivotable lever and which is to be engaged with the recess 107 of the carriage 100, but the present invention should not be restricted thereto or thereby. By way of non-limiting example, the engagement portion could be formed as a recess in the retaining member 5. In this case, a mating engagement portion in the carriage 100 is preferably formed as a protrusion fit into the recess.

Figure 22A:
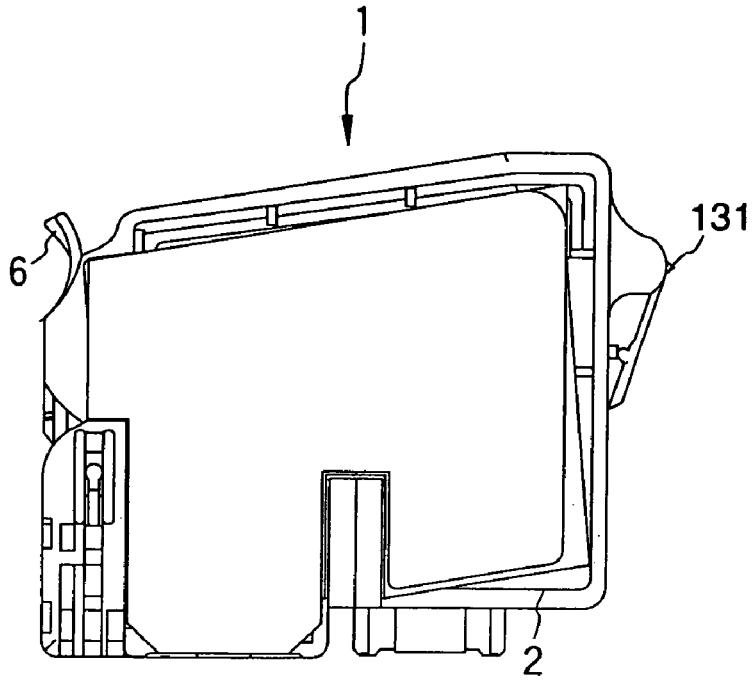
FIG. 22A is a front view of an ink cartridge according to yet another embodiment of the present invention.
Figure 22B:
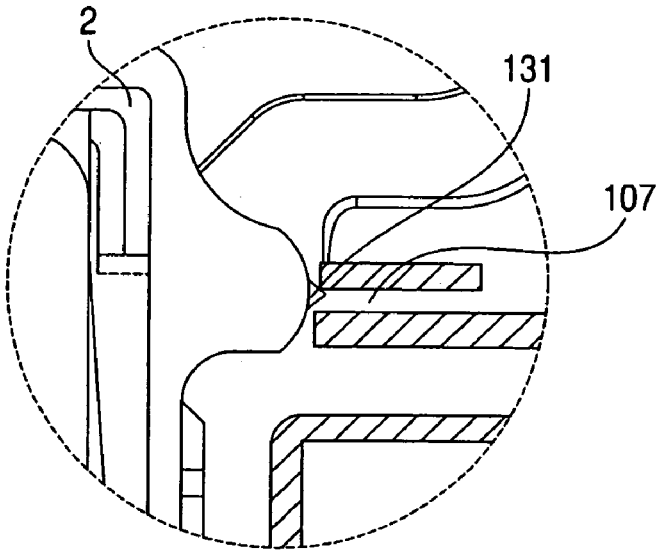
FIG. 22B is enlarged, partial view of the ink cartridge.

Further, the engagement portion could be directly formed on the wall of the container body 2, not via the retaining member 5. For example, an elastic protrusion may be attached to the wall of the container body 2 to serve as the engagement portion. More preferably, a spring biased member having a rounded distal end may be provided to the wall of the container body 2. In this case, the rounded distal end is protruded from the wall of the container. body 2 by the biasing force of a spring so that the spring biased member, when engaged with the recess 107, provides a predetermined retaining force to hold the ink cartridge 1, in the carriage 100. During the insertion or removal of the ink cartridge 1 from the carriage 100, the rounded distal end can be retracted toward the interior of the container body 2 against the biasing force of the spring for disengagement from the recess 107 because of the rounded shape of the distal end. Further, as shown in FIGS. 22A and 22B, a protrusion 131 may be formed on a relatively rigid portion of the container body 2 so that the protrusion 131 can be fitted into the recess 107 of the carriage 100 using the elasticity of, at least, portions of the carriage 100 defining the recess 107. That is, using the elasticity of the portions of the carriage 100 defining the recess 107, the ink cartridge 1 having the protrusion 131 can be inserted into, fixed onto and removed from the carriage 100.

(2) In an ink cartridge constructed according to (1), the engagement portion is substantially aligned with the at least one electrode in the Y-axis direction. By way of non-limiting example, as shown in FIG. 2C, the engagement protrusion 5*a* is aligned with the electrodes 7*a* in the Y-axis direction. This arrangement remarkably contributes to reliable contact between the electrodes 7*a* of the ink cartridge 1 and the electrodes 106 of the carriage 100.

Figure 1A:
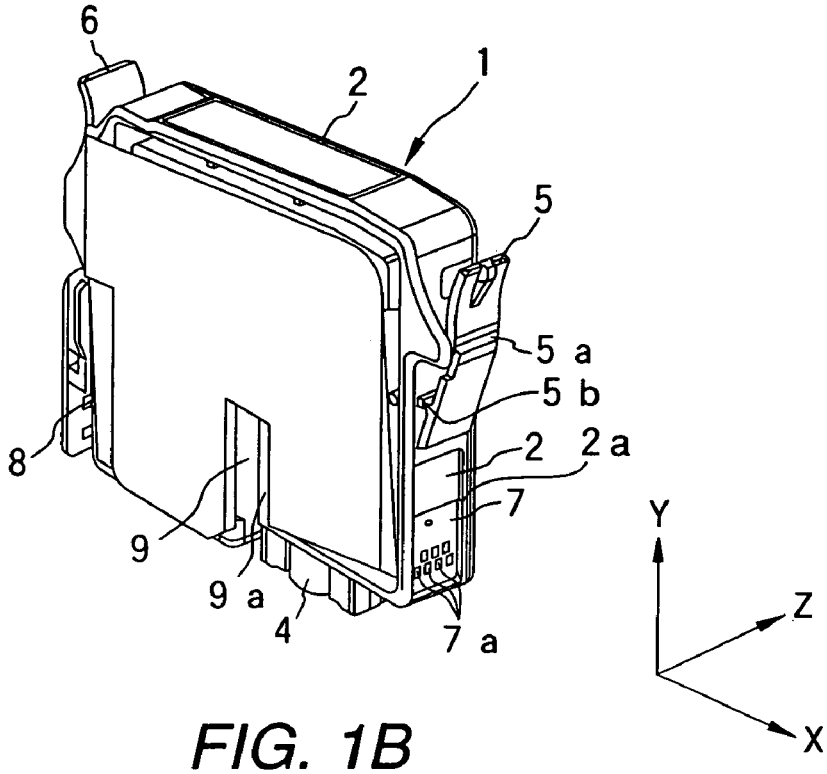
FIG. 1A and FIG. 1B are views showing front-side and rear-side external appearances, respectively, of a low-capacity ink cartridge according to an embodiment of the present invention.
Figure 1B:
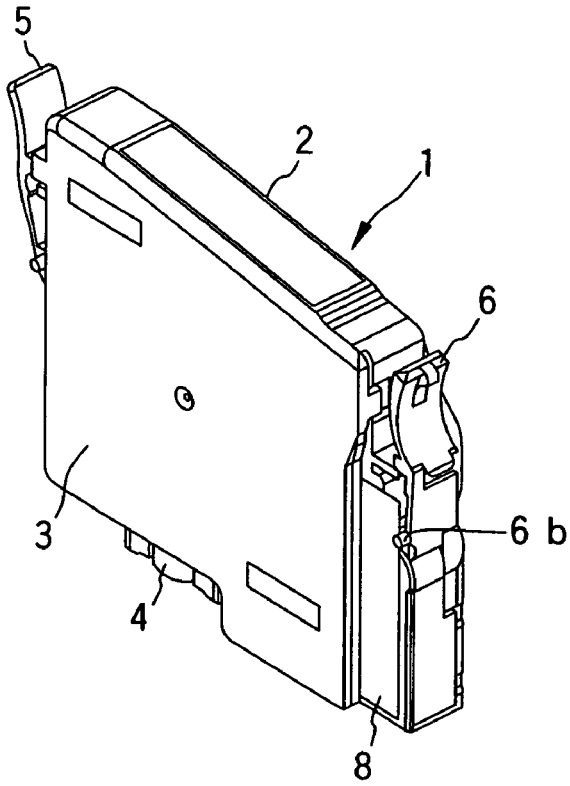
Figure 19A:
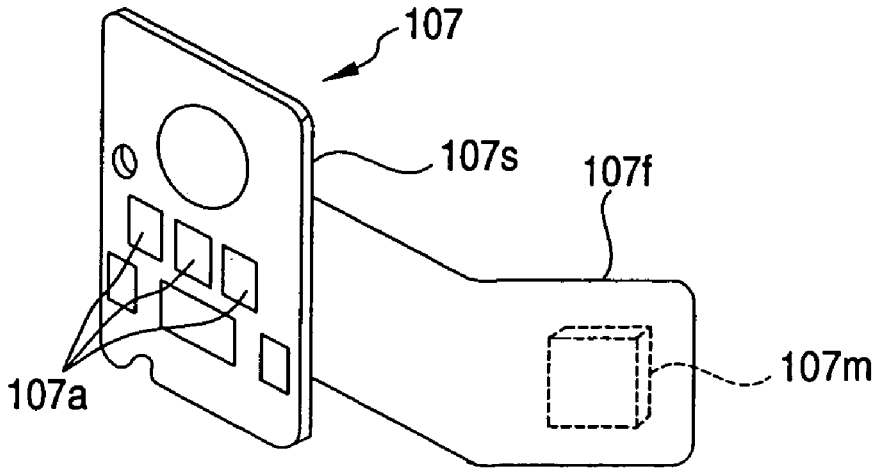
FIG. 19A is a perspective view showing an example of a memory device.
Figure 19B:
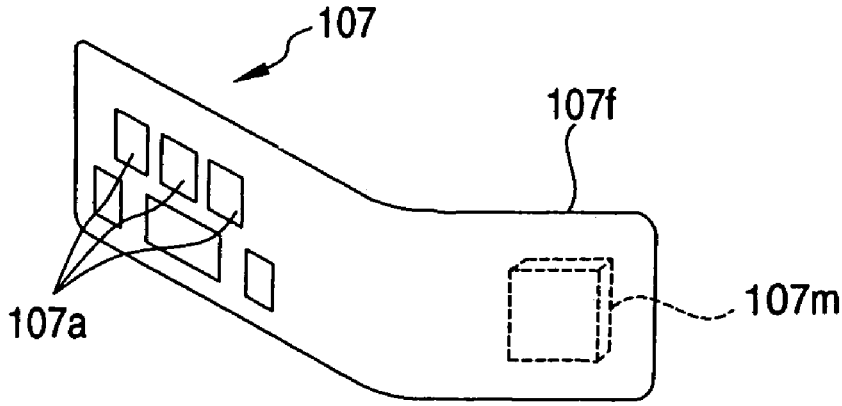
FIG. 19B is a perspective view showing another example of the memory device.

(3) In an ink cartridge constructed according to (1) or (2), the wall may have a recessed portion in which the at least one electrode is located. Byway of non-limiting example, as shown in FIGS. 1A and 7, the wall of the container body 2 has a recess 2*a* for storing a substrate (the memory device 7), the substrate having a first exposed surface on which the electrodes 7*a* are disposed and a second, hidden surface on which main circuit components of the memory device 7, electrically connected to the electrodes 7*a* are mounted. Accordingly, the electrodes 7*a* are located in the recessed portion 2*a*. In addition, the main circuit components of the memory device 7 may be disposed at a location other than the recess 2*a* using a FPC. For example, as shown in FIG. 19A, a memory device 107 includes a substrate 107*s*, electrodes 107*a* formed on the substrate 107*s*, a flexible printed circuit 107*f* in the form of a flexible sheet, and main circuit components (in the form of a chip) 107*m* that are electrically connected to the electrodes 107*a* via the FPC 107*f* and that are mounted on a hidden surface of the FPC 107*f*. The memory device 107 can be mounted onto the ink cartridge 1 such that the substrate including the electrodes 107*a* is mounted on a wall of the ink cartridge 1 and the main circuit components 107*f* of the memory device 107 are mounted on another wall other than the wall mounting the substrate 107*s* and the electrodes 107*a* thereon. Further, the substrate can be dispensed with using the FPC. For example, as shown in FIG. 19B, the memory device 107 can be constructed without using the substrate 107*s*. That is, the electrodes 107*a* can be formed directly on the FPC 107*f*.

Figure 20:
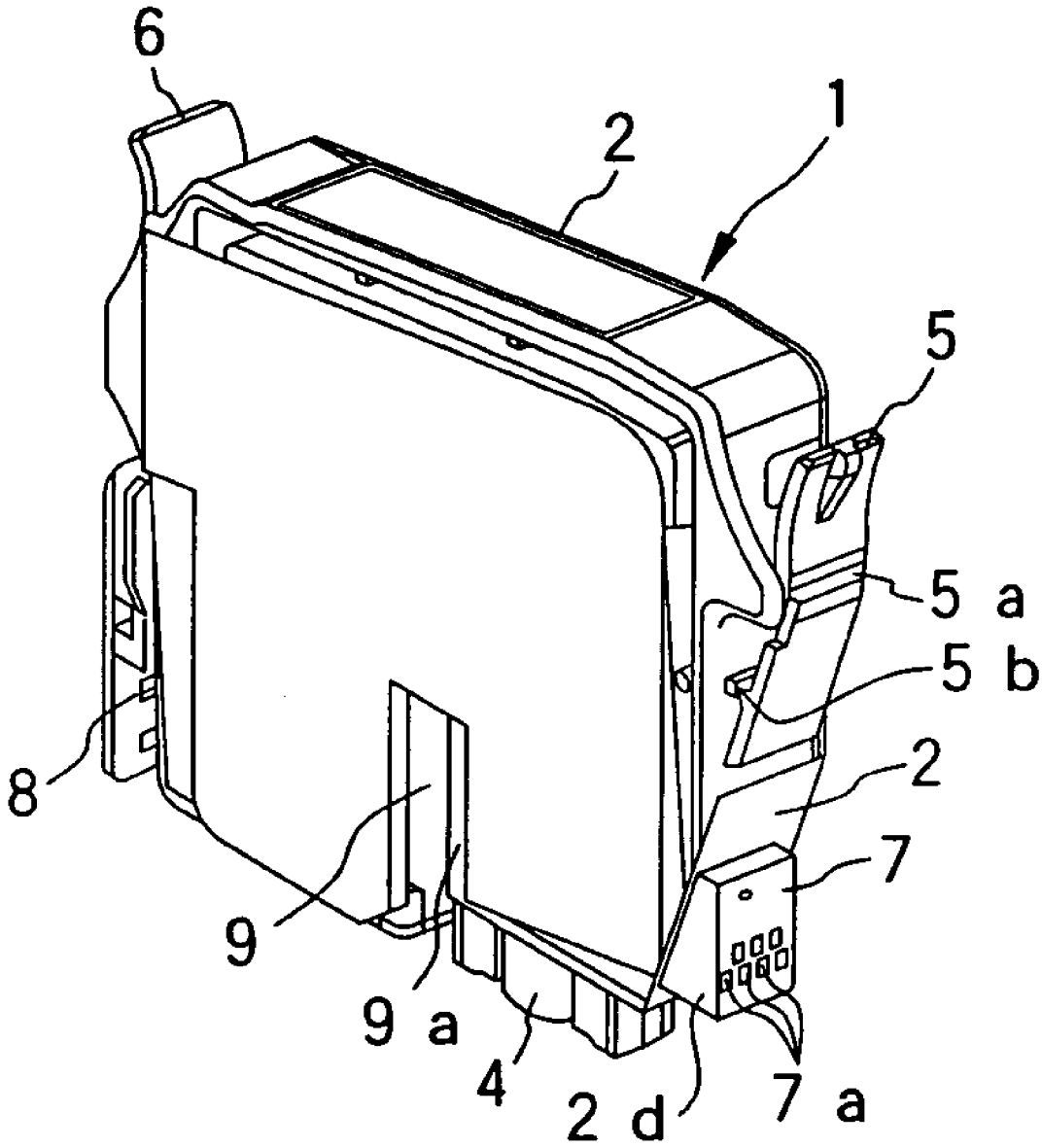
FIG. 20 is a perspective view showing an ink cartridge according to yet another embodiment of the present invention.

(4) In an ink cartridge constructed according to (1) or (2), the wall may have a protruded portion onto which the at least one electrode is located. The protruded portion may be formed on the wall of the container 2 in place of the recess 2*a* so that the electrodes 7*a* can be located on the protruded portion. For example, as shown in FIG. 20, a projecting portion 2*d* may be formed on the container body 2, which has a distal end surface extending parallel to the insertion direction of the ink cartridge 1. The electrodes 7*a* may be disposed on this distal end surface of the projecting portion 2*d*.

(5) In an ink cartridge constructed according to (1) or (2), the wall may have a first surface part on which at least one electrode is disposed, and a second surface part on which a pivotable lever having the engagement portion is disposed. By way of not limiting example, in the case of the first embodiment, the first surface part is defined by the recess 2*a* of the wall, and the second surface part is defined by the surface of the wall located above the recess 2*a*.

(6) In an ink cartridge constructed according to (5), the first surface part is flush with the second surface part. In the first embodiment, the first surface part is somewhat recessed from the second surface part, but these first and second surface parts may be flush with each other completely to provide a planar surface.

(7) In an ink cartridge constructed according to (5), the first and second surface parts has a level difference therebetween. A small level difference between the first and second surface parts is provided in the first embodiment. This small level difference may be made larger.

(8) In an ink cartridge constructed according to (5), the first surface part may be inclined relative to the second surface part. In the first embodiment, the first surface part is parallel to the second surface part, but may be inclined relative to the second surface part. By way of non-limiting example, FIG. 20 shows an ink cartridge having the first surface part inclined relative to the second surface part.

(9) In an ink cartridge constructed according to any one of (1) to (8), the main circuit components of the memory device are disposed on the first wall. By way of non-limiting example, in the first embodiment, the main components of the memory device are stored in the recess 2*c* of the wall of the container body 2.

(10) In an ink cartridge according to any one of (1) to (8), the main circuit components of the memory device may be disposed on a second wall other than the first wall. By way of non-limiting example, the main circuit components of the memory device 7 could be disposed on a side wall of the container body 2 using a FPC.

Figure 21A:
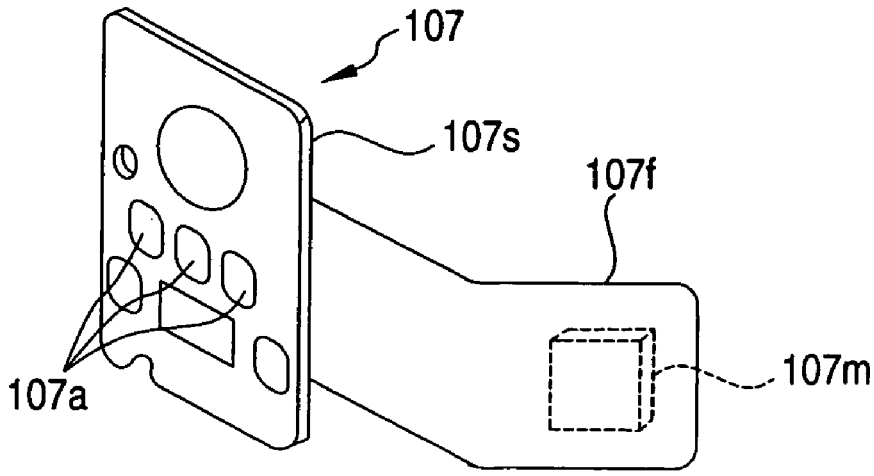
FIG. 21A is a perspective view showing yet another example of the memory device.
Figure 21B:
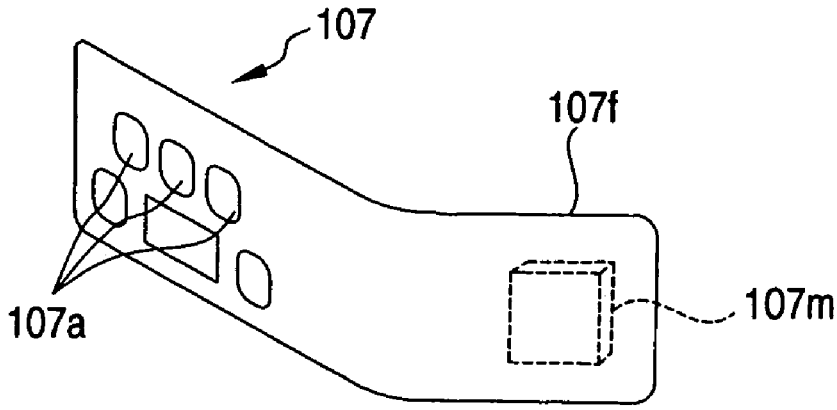
FIG. 21B is a perspective view showing still another example of the memory device.

(11) In an ink cartridge according to any one of (1) to (10), the at least one electrode may have a width and a length larger than the width. For example, as shown in FIG. 2C, a length L of the electrode 7 in the Y-axis direction is larger than a width W of the electrode 7*a* in the Z-axis direction. In addition, as shown in FIGS. 21A and 21B, each of the electrodes 107*a* having the larger length and smaller width may be formed into an oval or oblong shape.

(12) In an ink cartridge according to any one of (1) to (11), an ink supply port is provided, the ink supply port having an axis defining a first side and a second side opposite from the first side in an X-axis direction. For example, in the first embodiment, the ink cartridge 1 has the ink supply port 4 having an axis A, and the axis defines a first side B and a second side C opposite from the first side B with respect to the axis A in an X-axis direction.

(13) In an ink cartridge according to (12), the at least one electrode and the engagement portion are located in the first side. For example, in the first embodiment, the electrodes 7*a* and the engagement portion 5*a* are located in the first side B.

(14) In an ink cartridge according to (12) or (13), the at least one electrode and the engagement portion are located on the axis of the ink supply port as viewed in a Y-Z plane. By way of non-limiting example, a central electrode 7*a* in the upper row is located on the axis A, and the engagement portion 5*a* is also located on the axis A, as shown in FIG. 2C.

(15) In an ink cartridge according to (14), a center of the at least one electrode and a center of the engagement portion are preferably located on the axis of the ink supply port as viewed in the Y-Z plane. By way of non-limiting example, in the first embodiment, a center of the central electrode 7*a* in the upper row and a center of the engagement portion 5*a* are located on the axis A as shown in FIG. 2C.

(16) In an ink cartridge according to (12) or (13), the at least one electrode may include plural electrodes arrayed into at least one row, and the at least one row and the engagement portion are preferably located on the axis of the ink supply port as viewed in a Y-Z plane. By way of non-limiting example, in the first embodiment, two upper and lower rows of the electrodes 7*a* are both located on the axis A as shown in FIG. 2C.

(17) In an ink cartridge according to (16), a center of the at least one row and a center of the engagement portion are preferably located on the axis of the ink supply port as viewed in the Y-Z plane. By way of non-limiting example, in the first embodiment, a center of each of the two upper and lower rows is located on the axis A as shown in FIG. 2C since the electrodes 7*a* in each of upper and lower rows are symmetrically arranged with respect to the axis A as shown in FIG. 2C.

(18) In an ink cartridge according to any one of (12) to (17), the axis of the ink supply port may be located at a central position with respect to the container body in a Z-axis direction. The small capacity-type ink cartridge 1 employs this-arrangement.

(19) In an ink cartridge according to any one of (12) to (17), the axis of the ink supply port may be located at an offset position with respect to the container body in a Z-axis direction. The large capacity type ink cartridge 1' employs this arrangement.

(20) In an ink cartridge according to any one of (5) to (8), an ink supply port having an axis is provided, and at least one of the first and second surface parts are inclined relative to the axis to present at least in part a tapered configuration of the first wall. For example, in the first embodiment, the wall of the container, where the electrodes 7*a* and the retaining member 5 having the engagement protrusion Sa are disposed, extends in parallel to the axis A of the ink supply port 4. However, the invention should not be restricted thereto or thereby. By way of non-limiting example, that wall may be inclined in part or entirely with respect to the axis A of the ink supply port 4, so that a portion of the wall, closer to the ink supply port 4 than another portion of the wall in the Y-axis direction, is located closer to the axis A than the other portion of the wall in the X-axis direction. In this case, the electrodes 7*a* may be disposed on the inclined portion of the wall to be inclined with respect to the axis A.

(21) In an ink cartridge according to any one of (12) to (20), a slot is preferably provided, which extends substantially parallel to the axis of the ink supply port and located in the second side. By way of non-limiting example, in the first embodiment, the slot 9 is formed in the container body 2.

(22) In an ink cartridge according to any one of (1) to (11), an ink supply port and a slot are provided, the slot extending in the Y-axis direction, and being located in the vicinity of the ink supply port. In the first embodiment, the slot 9 is formed in the vicinity of the ink supply port 4. The slot 9 is preferably located in the second side, but may be located in the first side.

What is claimed is:

1. An ink cartridge detachably mountable on a carriage which is reciprocally movable in a recording apparatus and which has a carriage electrode, an engagement portion and an ink supply needle, the ink cartridge comprising:

an ink supply port connectable to the ink supply needle, the ink supply port being located in a leading end side in an insertion direction of the cartridge into the carriage;

first and second walls opposing each other, the first wall being substantially parallel to the insertion direction of the cartridge into the carriage;

a cartridge electrode connectable to the carriage electrode, the cartridge electrode being disposed on the first wall of the cartridge; and a retaining member disposed on the first wall of the cartridge, and having an engagement portion which is located at a trailing end side, with respect to the insertion direction, relative to the cartridge electrode such that an imaginary plane containing an axis of the ink supply port passes through both the cartridge electrode and the engagement portion of the retaining member and which is engageable with the engagement portion of the carriage, wherein the cartridge electrode is connected to the carriage electrode when the engagement portion of the retaining member is engaged with the engagement portion of the carriage.

2. An ink cartridge according to claim 1, further comprising: a guide member disposed on the second wall and guidable by the carriage when the cartridge is inserted into the carriage.

3. An ink cartridge according to claim 1 or 2, wherein the cartridge is fixable to the carriage exclusively using the retaining member disposed close to the cartridge electrode.

4. An ink cartridge according to claim 1 or 2, wherein the retaining member serves as a guide member when the cartridge is inserted into the carriage.

5. An ink cartridge according to claim 1 or 2, wherein the retaining member has at least two side surfaces, both being slidingly guided by the carriage to restrict a position of the first wall of the cartridge in a width direction when the cartridge is inserted into the carriage.

6. An ink cartridge according to claim 5, wherein at least one said side surface has a sidewards-extending projection which is received in a groove of the carriage to move the engagement portion of the retaining member toward the engagement portion of the carriage along a plane parallel to the insertion direction and perpendicular to the width direction when the cartridge is inserted into the carriage.

7. An ink cartridge according to claim 1 or 2, wherein the cartridge electrode includes a plurality of electrodes arrayed in at least one row and the imaginary plane passes through at least a center of the at least one row.

8. An ink cartridge according to claim 1 or 2, farther comprising: a guide recess located substantially in a central region of the cartridge and extending in the insertion direction.

9. An ink cartridge according to claim 8, wherein a leading end region of the guide recess in the insertion direction is opened to a front surface side of the cartridge.

10. An ink cartridge according to claim 1 or 2, wherein the engagement portion of the retaining member is substantially aligned with the cartridge electrode in the Y-axis direction.

11. An ink cartridge according to claim 1 or 2, wherein the first wall has a recessed portion in which the cartridge electrode is located.

12. An ink cartridge according to claim 1 or 2, wherein the first wall has a protruded portion on which the cartridge electrode is located.

13. An ink cartridge according to claim 1 or 2, wherein the first wall has a first surface part on which the cartridge electrode is disposed, and a second surface part on which the retaining member having the engagement portion is disposed.

14. An ink cartridge according to claim 13, wherein the first surface part is defined by a surface of a circuit board attached to the cartridge, and the cartridge electrode is located on the surface of the circuit board.

15. An ink cartridge according to claim 13, wherein the first surface part is approximately flush with the second surface part.

16. An ink cartridge according to claim 13, wherein the first and second surface parts have a level difference therebetween.

17. An ink cartridge according to claim 13, wherein the first surface part is inclined relative to the second surface part.

18. An ink cartridge according to claim 1 or 2, wherein a main circuit component is disposed on the first wall and is electrically connected to the cartridge electrode.

19. An ink cartridge according to claim 1 or 2, wherein a main circuit component is disposed on a second wall other than the first wall and is electrically connected to the cartridge electrode.

20. An ink cartridge according to claim 1 or 2, wherein the cartridge electrode has a width and a length that is larger than the width.

21. An ink cartridge according to claim 1 or 2, wherein the ink supply port has the axis extending in a Y-axis direction and defining a first side and a second side opposite from the first side in an X-axis direction.

22. An ink cartridge according to claim 21, wherein the cartridge electrode and the engagement portion of the retaining member are located in the first side.

23. An ink cartridge according to claim 22, wherein the cartridge electrode and the engagement portion of the retaining member are located on the axis of the ink supply port as viewed in a Y-Z plane.

24. An ink cartridge according to claim 23, wherein a center of the cartridge electrode and a center of the engagement portion of the retaining member are located on the axis of the ink supply port as viewed in the Y-Z plane.

25. An ink cartridge according to claim 23, wherein the cartridge electrode includes a plurality of electrodes arrayed in at least one row, and the at least one row and the engagement portion of the retaining member are located on the axis of the ink supply port as viewed in the Y-Z plane.

26. An ink cartridge according to claim 23, wherein a center of the at least one row and a center of the engagement portion of the retaining member are located on the axis of the ink supply port as viewed in the Y-Z plane.

27. An ink cartridge according to claim 23, wherein the axis of the ink supply port is located at a central position with respect to the cartridge in a Z-axis direction.

28. An ink cartridge according to claim 23, wherein the axis of the ink supply port is located at an offset position with respect to the cartridge in a Z-axis direction.

29. An ink cartridge according to claim 23, wherein the ink supply port has the axis extending in the Y-axis direction, and wherein at least one of the first and second surface parts are inclined relative to the axis of the ink supply port to present at least in part a tapered configuration of the first wall.

30. A set of ink cartridges according to claim 1, respectively storing ink of different kinds, mountable to an ink jet recording device, and each said ink cartridge comprising a container body having an ink supply port and a cover member sealing an opened surface of the container body, wherein the ink supply ports, and members, which are disposed on the respective ink cartridges to cooperate with the ink jet recording device, are located at positions equidistant from side surfaces of the container bodies of the respective ink cartridges.

31. A set of ink cartridges according to claim 30, wherein the member that cooperates with the ink jet recording device includes at least one of a cartridge identifying block for judging a kind of the ink stored in the associated container, the cartridge electrode, an air release valve for allowing an ink storage chamber to communicate with the atmosphere, and the retaining member for fixing the ink cartridge to the ink inject recording device.

32. A set of ink cartridges according to claim 30, wherein at least one of the ink cartridges has a larger capacity by way of a greater depth of the container body than the other ink cartridges.

33. A set of ink cartridges according to claim 32, wherein a depth of the container body of at least one of the ink cartridges, as measured from the side surface of the container body, is set larger than that of the other ink cartridges.

34. An ink jet recording device that can receive ink from an ink cartridge having an ink supply port located in a leading end side in an insertion direction of the cartridge into the ink jet recording device, first and second walls opposing each other, the first wall being substantially parallel to the insertion direction, a cartridge electrode disposed on the first wall of the cartridge and a retaining member disposed on the first wall of the cartridge, and having an engagement portion which is located at a trailing end side, with respect to the insertion direction, relative to the cartridge electrode such that an imaginary plane containing an axis of the ink supply port passes through both the cartridge electrode and the engagement portion of the retaining member, the recording device comprising:

a carriage which detachably mounts the ink cartridge thereon, and which is reciprocally movable in the recording apparatus, the carriage including;

a carriage electrode disposed in a side corresponding to a region where the retaining member of the cartridge is provided when the cartridge is mounted in the carriage, and connected to the cartridge electrode;

a carriage engagement portion disposed in the same side and connected to the engagement portion of the retaining member of the cartridge when the cartridge is mounted in the carriage;

an ink supply needle connected to the ink supply port of the cartridge when the cartridge is mounted; and an elastic member for applying an urging force substantially parallel to the insertion direction of the ink cartridge into the carriage.

35. An ink jet recording device according to claim 34, further comprising:

a recess formed in a region opposite to the retaining member, extending in the insertion direction of the ink cartridge, and engageable with a side surface of the retaining member.

36. An ink jet recording device according to claim 34 or 35, wherein a plurality of regions for respectively mounting a plurality of the ink cartridges are defined, and plural said carriage electrodes are respectively brought into contact with plural said cartridge electrodes, and are located at positions equidistanced from one side surface of the respective ink cartridges in the respective regions.

37. An ink jet recording device according to claim 34, wherein the carriage further includes:

a guide portion which slidingly guides a side surface of the retaining member to restrict a position of the first wall of the cartridge in a width direction when the ink cartridge is inserted into the carriage.

38. An ink jet recording device according to claim 37, wherein the carriage further includes:

a groove which receives a sidewards-extending projection of the side surface of the retaining member to move the engagement portion of the retaining member toward the engagement portion of the carriage along a plane parallel to the insertion direction and perpendicular to the width direction when the ink cartridge is inserted into the carriage.

39. An ink jet recording device that can receive ink from an ink cartridge having an ink supply port located in a leading end side in an insertion direction of the cartridge into the ink jet recording device, first and second walls opposing each other, the first wall being substantially parallel to the insertion direction, a cartridge electrode disposed on the first wall of the cartridge and a retaining member disposed on the first wall of the cartridge, and having an engagement portion which is located at a trailing end side, with respect to the insertion direction, relative to the cartridge electrode such that an imaginary plane containing an axis of the ink supply port passes through both the cartridge electrode and the engagement portion of the retaining member, and a guide recess located substantially in a central region of the cartridge and extending in the insertion direction, said recording device comprising:

a carriage which detachably mounts the ink cartridge thereon, and which is reciprocally movable in the recording apparatus, the carriage including;

a carriage electrode disposed in a side corresponding to a region where the retaining member of the cartridge is provided when the cartridge is mounted in the carriage, and connected to the cartridge electrode;

a carriage engagement portion disposed in the same side and connected to the engagement portion of the retaining member of the cartridge when the cartridge is mounted in the carriage;

an ink supply needle connected to the ink supply port of the cartridge when the cartridge is mounted;

an elastic member for applying an urging force substantially parallel to the insertion direction of the ink cartridge into the carriage a guide protrusion engageable with the guide recess; wherein the elastic member is disposed in a side opposite to the retaining member with respect to the guide protrusion.

40. An ink jet recording device according to claim 39, wherein a leading end region of the guide protrusion in the insertion direction of the ink cartridge has an L-shaped cross-section.

41. An ink cartridge detachably mountable on a carriage which is reciprocally movable in a recording apparatus and which has a carriage electrode, an engagement portion, a projection, and an ink supply needle, the ink cartridge comprising:

a first surface lying in a plane, the first surface having a recess for receiving the projection and an ink supply port connectable to the ink supply needle;

first and second walls opposing each other, at least a portion of the first wall being substantially parallel to an insertion direction of the cartridge into the carriage and lying in a plane that intersects the plane of the first surface, the ink supply port being located in the first surface at a leading end side in the insertion direction and between the recess and a position where the plane of the first surface intersects the plane in which the portion of the first wall lies;

a cartridge electrode connectable to the carriage electrode, the cartridge electrode being disposed on the first wall of the cartridge; and a retaining member disposed on the first wall of the cartridge, and having an engagement portion which is located at a trailing end side, with respect to the insertion direction, relative to the cartridge electrode and which is engageable with the engagement portion of the carriage, wherein the cartridge electrode is connected to the carriage electrode when the engagement portion of the retaining member is engaged with the engagement portion of the carriage.

42. An ink cartridge according to claim 41, further comprising: a guide member disposed on the second wall and guidable by the carriage when the cartridge is inserted into the carriage.

43. An ink cartridge according to claim 41 or 42, wherein the cartridge is fixable to the carriage exclusively using the retaining member disposed close to the cartridge electrode.

44. An ink cartridge according to claim 41 or 42, wherein the retaining member serves as a guide member when the cartridge is inserted into the carriage.

45. An ink cartridge according to claim 41 or 42, wherein the retaining member has at least two side surfaces, both being slidingly guided by the carriage to restrict a position of the first wall of the cartridge in a width direction when the cartridge is inserted into the carriage.

46. An ink cartridge according to claim 45, wherein at least one said side surface has a sidewards-extending projection which is received in a groove of the carriage to move the engagement portion of the retaining member toward the engagement portion of the carriage along a plane parallel to the insertion direction and perpendicular to the width direction when the cartridge is inserted into the carriage.

47. An ink cartridge according to claim 41 or 42, wherein the cartridge electrode includes a plurality of electrodes arrayed in at least one row and the imaginary plane passes through at least a center of the at least one row.

48. An ink cartridge according to claim 41 or 42, further comprising: a guide recess located substantially in a central region of the cartridge and extending in the insertion direction.

49. An ink cartridge according to claim 48, wherein a leading end region of the guide recess in the insertion direction is opened to a front surface side of the cartridge.

50. An ink cartridge according to claim 41 or 42, wherein the engagement portion of the retaining member is substantially aligned with the cartridge electrode in the Y-axis direction.

51. An ink cartridge according to claim 41 or 42, wherein the first wall has a recessed portion in which the cartridge electrode is located.

52. An ink cartridge according to claim 41 or 42, wherein the first wall has a protruded portion on which the cartridge electrode is located.

53. An ink cartridge according to claim 41 or 42, wherein the first wall has a first surface part on which the cartridge electrode is disposed, and a second surface part on which the retaining member having the engagement portion is disposed.

54. An ink cartridge according to claim 53, wherein the first surface part is defined by a surface of a circuit board attached to the cartridge, and the cartridge electrode is located on the surface of the circuit board.

55. An ink cartridge according to claim 53, wherein the first surface part is approximately flush with the second surface part.

56. An ink cartridge according to claim 53, wherein the first and second surface parts have a level difference therebetween.

57. An ink cartridge according to claim 53, wherein the first surface part is inclined relative to the second surface part.

58. An ink cartridge according to claim 41 or 42, wherein a main circuit component is disposed on the first wall and is electrically connected to the cartridge electrode.

59. An ink cartridge according to claim 41 or 42, wherein a main circuit component is disposed on a second wall other than the first wall and is electrically connected to the cartridge electrode.

60. An ink cartridge according to claim 41 or 42, wherein the cartridge electrode has a width and a length that is larger than the width.

61. An ink cartridge according to claim 41 or 42, wherein the ink supply port has an axis extending in a Y-axis direction and defining a first side and a second side opposite from the first side in an X-axis direction.

62. An ink cartridge according to claim 61, wherein the cartridge electrode and the engagement portion of the retaining member are located in the first side.

63. An ink cartridge according to claim 62, wherein the cartridge electrode and the engagement portion of the retaining member are located on the axis of the ink supply port as viewed in a Y-Z plane.

64. An ink cartridge according to claim 63, wherein a center of the cartridge electrode and a center of the engagement portion of the retaining member are located on the axis of the ink supply port as viewed in the Y-Z plane.

65. An ink cartridge according to claim 63, wherein the cartridge electrode includes a plurality of electrodes arrayed in at least one row, and the at least one row and the engagement portion of the retaining member are located on the axis of the ink supply port as viewed in the Y-Z plane.

66. An ink cartridge according to claim 63, wherein a center of the at least one row and a center of the engagement portion of the retaining member are located on the axis of the ink supply port as viewed in the Y-Z plane.

67. An ink cartridge according to claim 63, wherein the axis of the ink supply port is located at a central position with respect to the cartridge in a Z-axis direction.

68. An ink cartridge according to claim 63, wherein the axis of the ink supply port is located at an offset position with respect to the cartridge in a Z-axis direction.

69. An ink cartridge according to claim 63, wherein the ink supply port has the axis extending in the Y-axis direction, and wherein at least one of the first and second surface parts are inclined relative to the axis of the ink supply port to present at least in part a tapered configuration of the first wall.

70. A set of ink cartridges according to claim 41, respectively storing ink of different kinds, mountable to an ink jet recording device, and each said ink cartridge comprising an ink supply port and a cover member sealing an opened surface of the cartridge, wherein the ink supply ports, and members, which are disposed on the respective ink cartridges to cooperate with the ink jet recording device, are located at positions equidistant from side surfaces of the respective ink cartridges.

71. A set of ink cartridges according to claim 70, wherein the member that cooperates with the ink jet recording device includes at least one of a cartridge identifying block for judging a kind of the ink stored in the associated cartridge, the cartridge electrode, an air release valve for allowing an ink storage chamber to communicate with the atmosphere, and the retaining member for fixing the ink cartridge to the ink inject recording device.

72. A set of ink cartridges according to claim 70, wherein at least one of the ink cartridges has a larger capacity by way of a greater depth of the cartridge than the other ink cartridges.

73. A set of ink cartridges according to claim 72, wherein a depth of at least one of the ink cartridges, as measured from the side surface of the cartridge, is set larger than that of the other ink cartridges.

74. An ink jet recording device that can receive ink from an ink cartridge having a first surface lying in a plane, the first surface having a recess for receiving a projection and an ink supply port, first and second walls opposing each other, at least a portion of the first wall being substantially parallel to an insertion direction of the cartridge into the ink jet recording device and lying in a plane that intersects the plane of the first surface, the ink supply port being located in the first surface at a leading end side in the insertion direction and between the recess and a position where the plane of the first surface intersects the plane in which the portion of the first wall lies, a cartridge electrode disposed on the first wall of the cartridge and a retaining member disposed on the first wall of the cartridge, and having an engagement portion which is located at a trailing end side, with respect to the insertion direction, relative to the cartridge electrode, the recording device comprising:

a carriage which detachably mounts the ink cartridge thereon, and which is reciprocally movable in the recording apparatus, the carriage including;

a carriage electrode disposed in a side corresponding to a region where the retaining member of the cartridge is provided when the cartridge is mounted in the carriage, and connected to the cartridge electrode;

the projection;

a carriage engagement portion disposed in the same side and connected to the engagement portion of the retaining member of the cartridge when the cartridge is mounted in the carriage;

an ink supply needle connected to the ink supply port of the cartridge when the cartridge is mounted; and an elastic member for applying an urging force substantially parallel to the insertion direction of the ink cartridge into the carriage.

75. An ink jet recording device that can receive ink from an ink cartridge having a first surface lying in a plane, the first surface having a recess for receiving a projection and an ink supply port, first and second walls opposing each other, at least a portion of the first wall being substantially parallel to an insertion direction of the cartridge into the ink jet recording device and lying in a plane that intersects the plane of the first surface, the ink supply port being located in the first surface at a leading end side in the insertion direction and between the recess and a position where the plane of the first surface intersects the plane in which the portion of the first wall lies, a cartridge electrode disposed on the first wall of the cartridge and a retaining member disposed on the first wall of the cartridge, having an engagement portion which is located at a trailing end side, with respect to the insertion direction, relative to the cartridge electrode, said recording device comprising:

a carriage which detachably mounts the ink cartridge thereon, and which is reciprocally movable in the recording apparatus, the carriage including;

a carriage electrode disposed in a side corresponding to a region where the retaining member of the cartridge is provided when the cartridge is mounted in the carriage, and connected to the cartridge electrode;

the projection;

a carriage engagement portion disposed in the same side and connected to the engagement portion of the retaining member of the cartridge when the cartridge is mounted in the carriage;

an ink supply needle connected to the ink supply port of the cartridge when the cartridge is mounted;

an elastic member for applying an urging force substantially parallel to the insertion direction of the ink cartridge into the carriage a guide protrusion engageable with the guide recess; wherein the elastic member is disposed in a side opposite to the retaining member with respect to the guide protrusion.

* * * * *